US005286588A

United States Patent [19]

Suzuki

[11] Patent Number: 5,286,588

[45] Date of Patent: Feb. 15, 1994

[54] ELECTROPHOTOGRAPHIC PHOTOCONDUCTOR

[75] Inventor: Yasuo Suzuki, Numazu, Japan

[73] Assignee: Ricoh Company, Ltd., Tokyo, Japan

[21] Appl. No.: 952,154

[22] Filed: Sep. 28, 1992

Related U.S. Application Data

[63] Continuation of Ser. No. 565,160, Aug. 10, 1990, abandoned.

[30] Foreign Application Priority Data

Aug. 24, 1989 [JP] Japan ..... 1-217985

[51] Int. Cl.[5] ..... G03G 5/047

[52] U.S. Cl. ..... 430/58; 430/59

[58] Field of Search ..... 430/58, 59

[56] References Cited

U.S. PATENT DOCUMENTS 4,563,408 1/1986 Lin et al. ..... 430/59
4,599,286 7/1986 Limburg et al. ..... 430/59
4,741,981 5/1988 Hashimoto et al. ..... 430/58

FOREIGN PATENT DOCUMENTS 155047 6/1988 Japan ..... 430/59
266548 10/1989 Japan ..... 430/58

*Primary Examiner*—Roland Martin
*Attorney, Agent, or Firm*—Oblon, Spivak, McClelland, Maier & Neustadt

[57] ABSTRACT

An electrophotographic photoconductor comprising an electroconductive support, and a photoconductive layer formed thereon, comprising (i) a charge generating material, (ii) a charge transporting material, and (iii) a hydroquinone compound having at least one group which contains 4 or more carbon atoms, represented by the following formula:

45 Claims, No Drawings

ELECTROPHOTOGRAPHIC PHOTOCONDUCTOR

This application is a continuation of application Ser. No. 07/565,160, filed on Aug. 10, 1990, now abandoned.

BACKGROUND OF THE INVENTION

Field of the Invention

This invention relates to an improved electrophotographic photoconductor, and more particularly to an electrophotographic photoconductor comprising a specific hydroquinone compound, which is free from the rise of the residual potential even after repeated charging and exposing to light thereof for an extended period of time and exhibits highly stable chargeability.

Discussion of Background

Inorganic materials such as selenium, cadmium sulfide and zinc oxide have been conventionally known as photoconductive materials usable for electrophotographic photoconductors. These inorganic photoconductive materials, however, are insufficient in photosensitivity, thermal stability and durability. For instance, selenium is readily crystallized when heated or contaminated by impurities, and its photoconductive properties thus deteriorate. Moreover, selenium has toxicity and does not have good impact resistance, and a photoconductor comprising it requires high production cost. Cadmium sulfide is also toxic, and a photoconductor comprising it is poor in resistance to moisture and durability. A photoconductor comprising zinc oxide is also poor in resistance to moisture and durability.

In contrast to the inorganic photoconductive materials, organic photoconductive materials have the advantage of good film-forming properties. In addition, a photoconductor comprising an organic photoconductive material is light, and can be produced inexpensively. For this reason, research and development on photoconductors using organic photoconductive materials have been actively made.

For instance, in the early stage of the research and development on the organic photoconductors, there were proposed a photoconductor comprising polyvinyl carbazole and 2,4,7-trinitro-9-fluorenone as disclosed in Japanese Patent Publication No. 50-10496, a photoconductor comprising polyvinyl carbazole sensitized with a pyrylium salt-based pigment as disclosed in Japanese Patent Publication No. 48-25658, and a photoconductor comprising as the main component a eutectic crystal complex. These photoconductors, however, are insufficient in photosensitivity and durability for use in practice.

Recently, a photoconductor of a function-separated type in which a charge generating layer and a charge transporting layer are laminated on an electroconductive support has been proposed: for instance, a photoconductor comprising chlorodiane blue and a hydrazone compound is disclosed in Japanese Patent Publication 55-42380. Furthermore, the bisazo compounds disclosed in Japanese Laid-Open Patent Applications 53-133455, 54-21728 and 54-22834 have been known as charge generating materials, and the compounds disclosed in Japanese Laid-Open Patent Applications 58-198043 and 58-199352 have been known as charge transporting materials. However, the function-separated-type photoconductors are still unsatisfactory, in particular, in durability.

Under these circumstances, attention is now being focused on the chargeability of the photoconductors. This is because the decrease of the chargeability causes the decrease of the optical density of reproduced images when the photoconductor is used in a copying apparatus. Furthermore, in the case where a photoconductor is used in a laser printer which utilizes the reversal developing method, the background of printed images tends to be stained when the chargeability is decreased.

In order to prevent the decrease of the chargeability of the photoconductor and the deterioration of the quality of images, it has been proposed to interpose a non-photosensitive intermediate layer between an electroconductive support and a photoconductive layer. However, when the intermediate layer is prepared by using a highly resistive material having high barrier properties, the photosensitivity decreases and the residual potential rises although the decrease of the chargeability is minimized: On the contrary, when the intermediate layer is prepared by using a material having a relatively low resistance, the decrease of the chargeability cannot be sufficiently restrained.

In the case where the photoconductor is used in a copying apparatus, the photoconductor is inevitably exposed to ozone produced by a corona charging device. It is considered that the ozone oxidizes the charge transporting material contained in the photoconductive layer, resulting in the decrease of the photosensitivity, the rise of the residual potential and the recrease of the charged potential. In order to protect the photoconductor from these adverse effects of .the ozone, the incorporation of an antioxidant into a photoconductive layer has been proposed as disclosed in Japanese Laid-Open Patent Applications 57-122444 and 61-156052; and the formation of a resinous layer having gas-barrier properties on a charge transporting layer has also been proposed as disclosed in Japanese Laid-Open Patent Application 63-135955.

However, in spite of the above various devices, a photoconductor which is free from the rise of the residual potential and has high photosensitivity and high durability has not been successfully accomplished so far.

SUMMARY OF THE INVENTION

Accordingly, an object of the present invention is to provide an electrophotographic photoconductor capable of eliminating the above-described shortcomings in the prior art, more specifically, an electrophotographic photoconductor which has high resistance to ozone, is free from the decrease of chargeability even after the repetitive use, can minimize the rise of the residual potential, and can produce images with a high optical density without staining the background of the image.

The above object of the present invention can be attained by an electrophotographic photoconductor comprising an electroconductive support, and a photoconductive layer formed thereon, comprising (i) a charge generating material, (ii) a charge transporting material, and (iii) a hydroquinone compound having at least one group which contains 4 or more carbon atoms.

DETAILED DESCRIPTION OF THE PREFERRED EMBODIMENTS

Since the electrophotographic photoconductor according to the present invention comprises a hydroquinone compound having at least one group which contains 4 or more carbon atoms, it is free from the decrease of chargeability even after the repetitive use, and from the rise of the residual potential. The photoconductor of the present invention therefore does not stain the background, and has a long life span and high reliability.

The hydroquinone compound having at least one group which contains 4 or more carbon atoms has formula [I]:

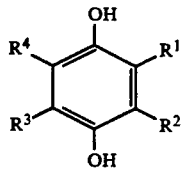

[I]

wherein $R^1$, $R^2$, $R^3$ and $R^4$ are independently hydrogen, a halogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an alkylamino group, an arylamino group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, an alkyloxycarbonyl group, an aryloxycarbonyl group, an alkylacyloxyl group, an arylacyloxyl group, a silyl group or a heterocyclic group, provided that at least one of $R^1$, $R^2$, $R^3$ and $R^4$ is a group having 4 or more carbon atoms.

Among the compounds having formula [I], compounds having formula [II] and [III] are preferably employed in the present invention:

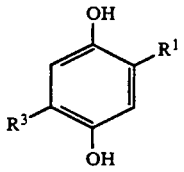

[II]

wherein $R^1$ and $R^3$ are independently hydrogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an acyl group or a heterocyclic group, provided that at least one of $R^1$ and $R^3$ has 6 or more, preferably 8 or more, carbon atoms; and

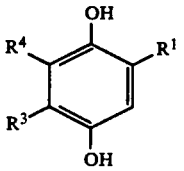

[III]

wherein

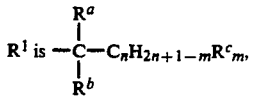

in which $R^a$ and $R^b$ are independently hydrogen or an alkyl group, but cannot be hydrogen at the same time, $R^c$ is a substituted or unsubstituted aryl group, an arylthio group, an aryloxy group, an arylacylamino group, an arylcarbamoyl group, an arylsulfonyl group, an aryloxycarbonyl group, an arylacyloxyl group, an arylamino group, an arylsulfonamide group or an arylsulfonyloxy group, $R^a$ and $R^b$ can be combined with $R^c$ to form a ring having 5 to 10 carbon atoms, n is an integer of 1 to 5, and m is 1 or 2, and $R^3$ or $R^4$ is a substituted or unsubstituted alkyl group having 4 to 20 carbon atoms, an aryloxy group, an alkoxyl group, a cycloalkyl group, an aryl group, an aralkyl group or $R^7$.

Of the compounds [III], compounds having formula [IV] are more preferable:

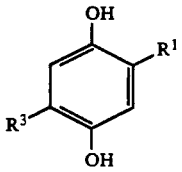

[IV]

wherein

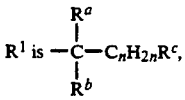

in which $R^a$, $R^b$ and $R^c$ are the same as $R^a$, $R^b$ and $R^c$ in formula [III], respectively, and n is an integer of 1 to 5, and $R^3$ is the same as $R^3$ in formula III]; and compounds having formula [V] are most preferable:

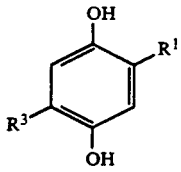

[V]

wherein

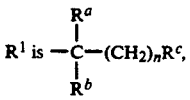

in which $R^a$ and $R^b$ are independently an alkyl group having 1 to 5 carbon atoms, $R^c$ is the same as $R^c$ in formula [III], $R^a$ and $R^b$ can be combined with $R^c$ to form a ring having 5 to 10 carbon atoms, and n is an integer of 1 to 5, and $R^3$ is a substituted or unsubstituted cycloalkyl group, an aryl group or $R^3$ Specific examples of the hydroquinone compounds having at least one group which contains 4 or more carbon atoms (hereinafter referred to simply as the hydroquinone compounds) usable in the present invention are enumerated Compounds Nos. I-1 to I-293). The present invention, however, is not limited by these compounds.
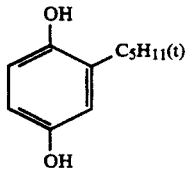
I-1
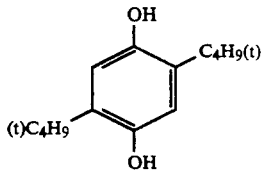
I-2
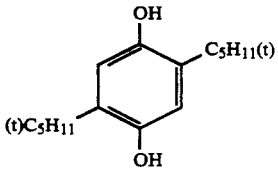
I-3
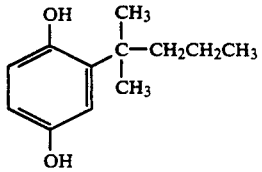
I-4
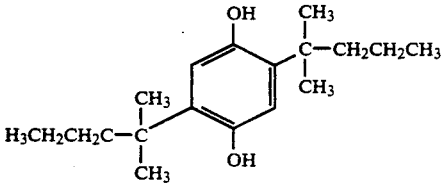
I-5
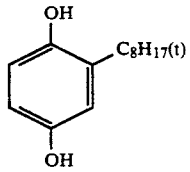
I-6
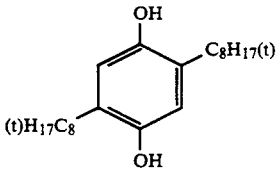
I-7
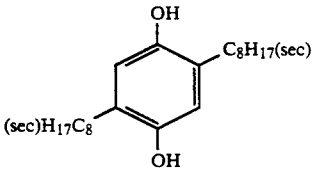
I-8
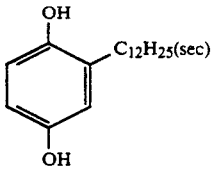
I-9
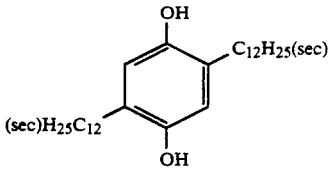
I-10
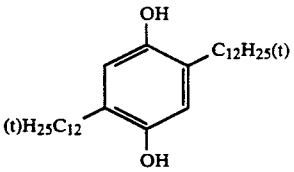
I-11
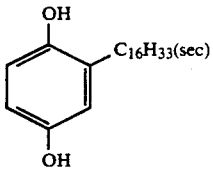
I-12
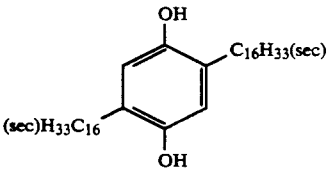
I-13
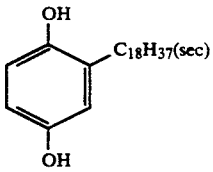
I-14
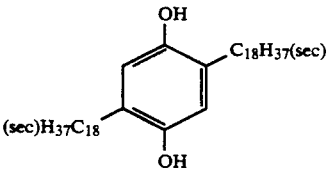
I-15
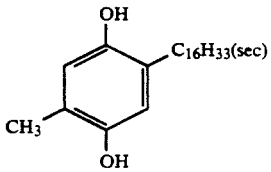
I-16

-continued
I-17
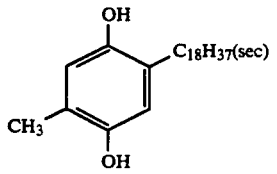
I-18
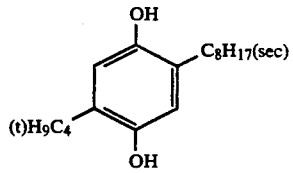
I-19
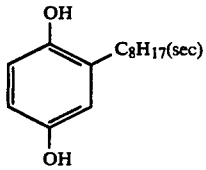
I-20
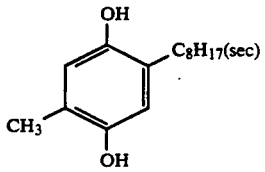
I-21
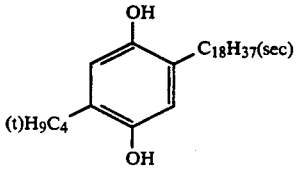
I-22
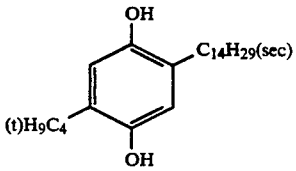
I-23
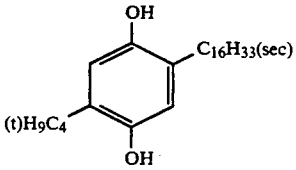
I-24
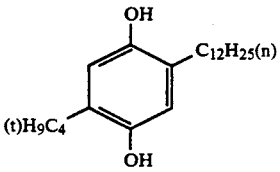
I-25
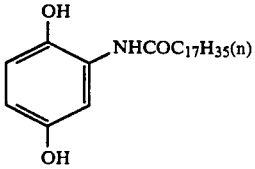
I-26
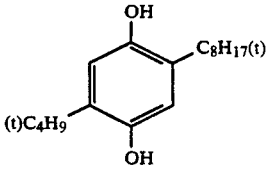
I-27
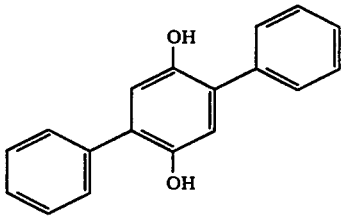
I-28
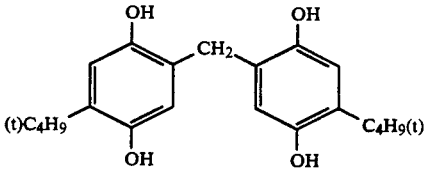
I-29
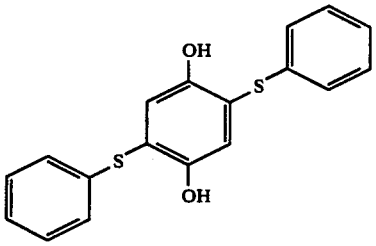
I-30
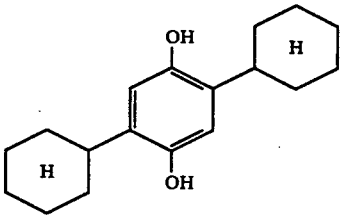
I-31
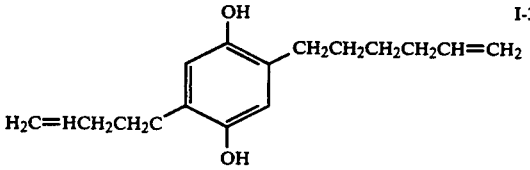
I-32
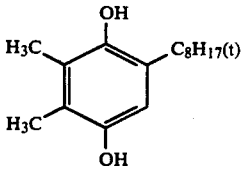

-continued
I-33
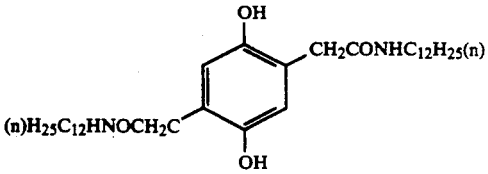
I-34
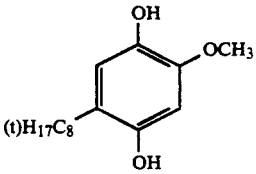
I-35
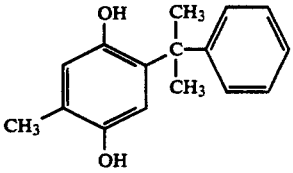
I-36
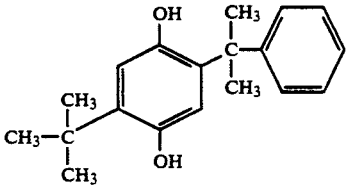
I-37
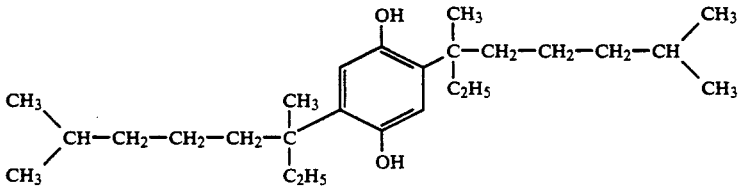
I-38
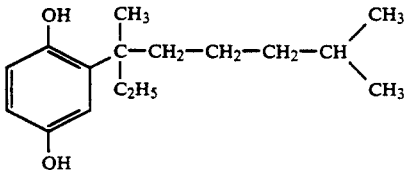
I-39
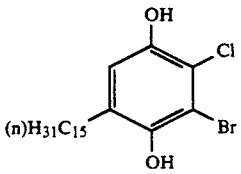
I-40
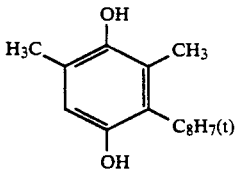
I-41
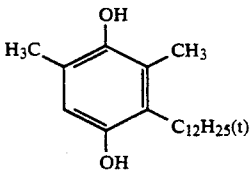
I-42
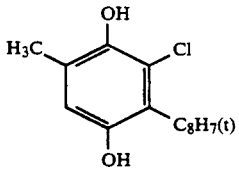
I-43
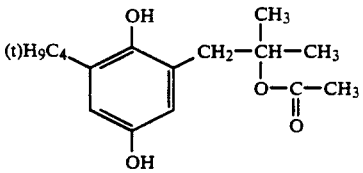
I-44
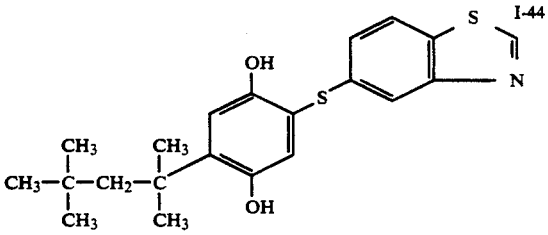
I-45
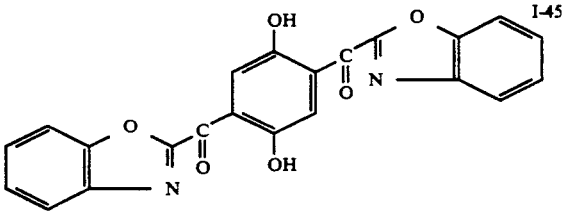
I-46
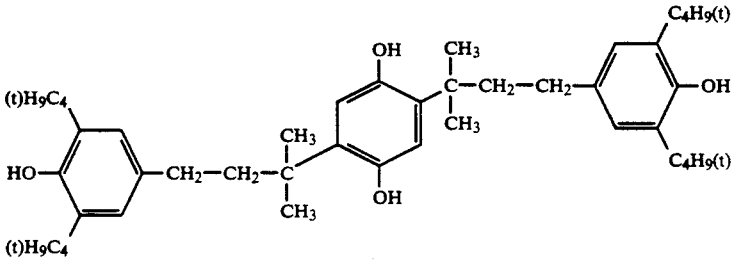

-continued
I-47
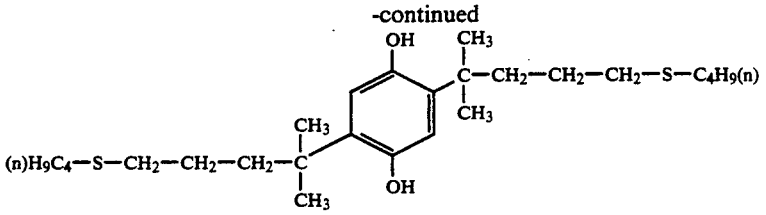
I-48
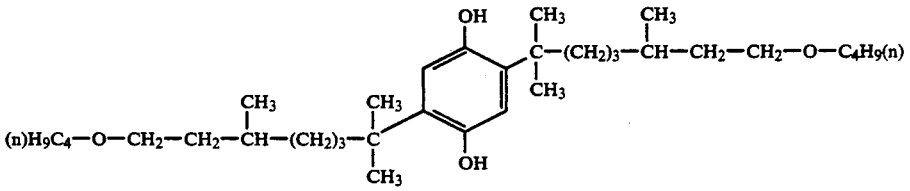
I-49
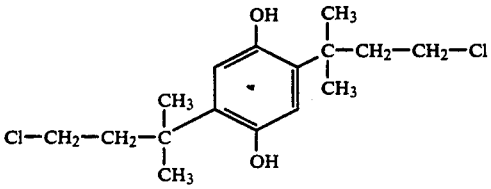
I-50
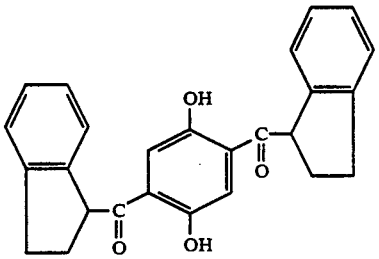
I-51
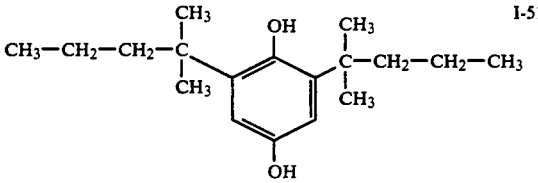
I-52
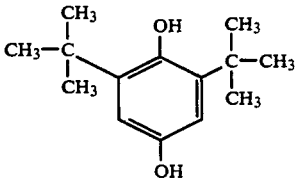
I-53
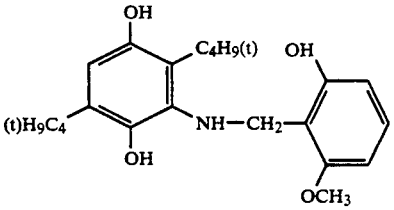
I-54
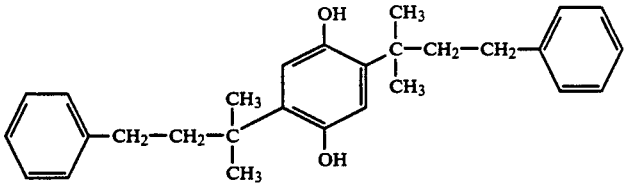
I-55
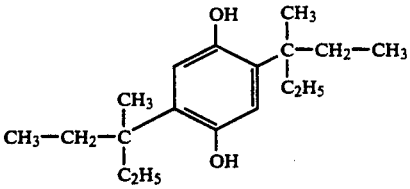
I-56
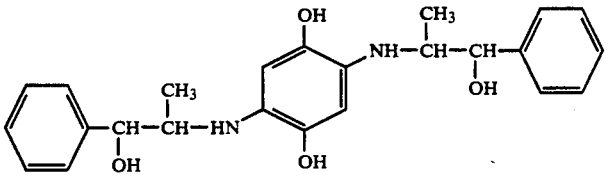

-continued
I-57
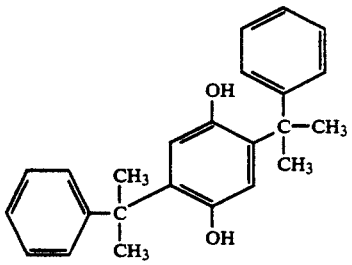
I-58
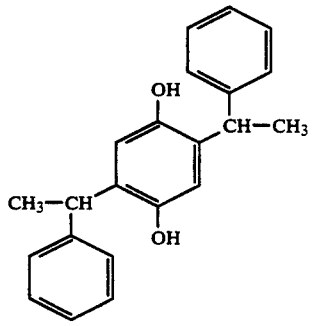
I-59
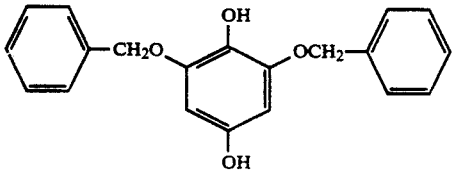
I-60
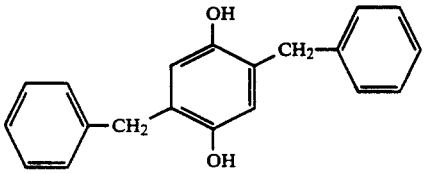
I-61
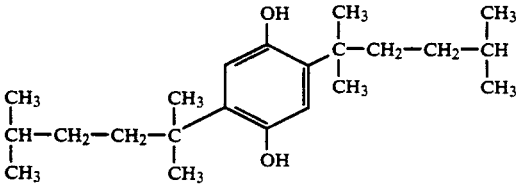
I-62
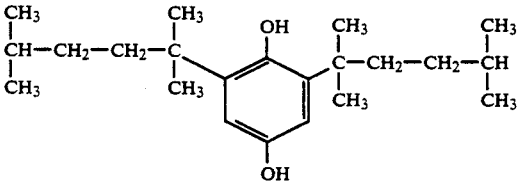
I-63
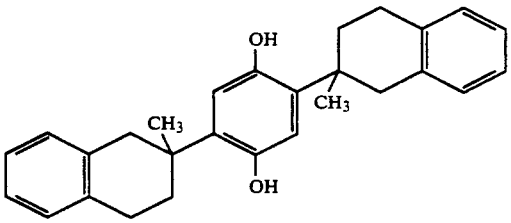
I-64
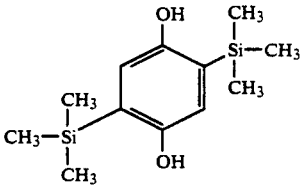
I-65
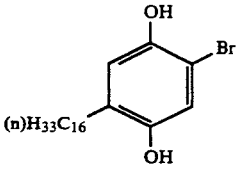
I-66
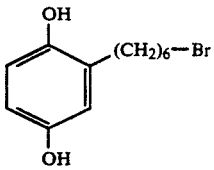
I-67
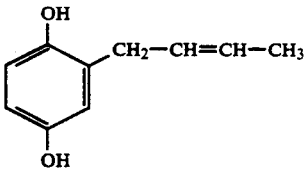
I-68
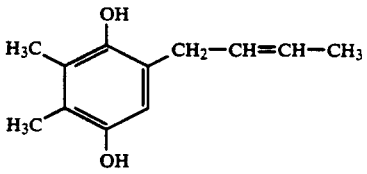
I-69
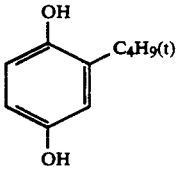
I-70
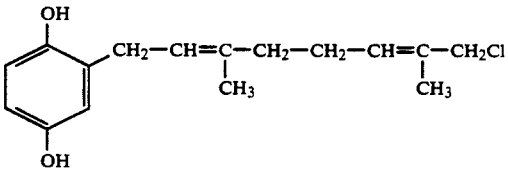

-continued
I-71
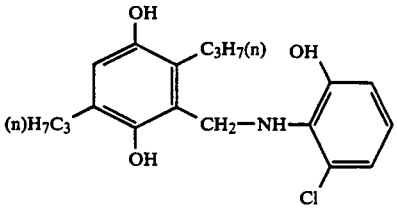
I-72
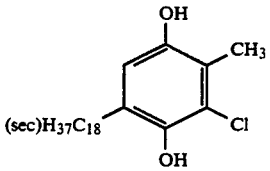
I-73
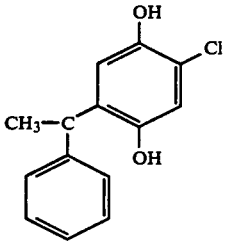
I-74
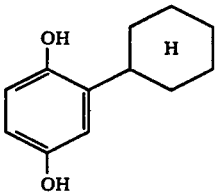
I-75
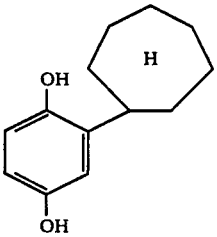
I-76
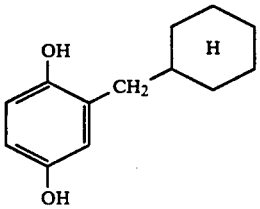
I-77
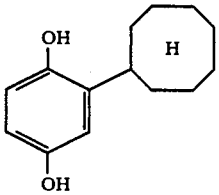
I-78
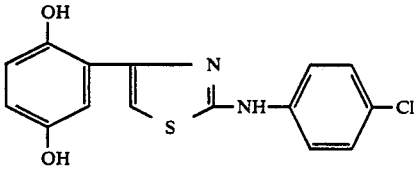
I-79
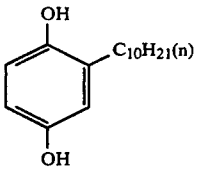
I-80
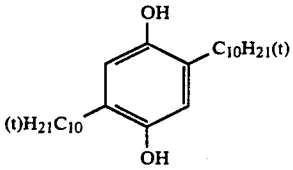
I-81
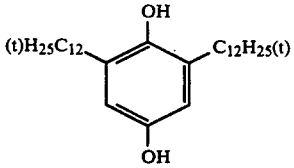
I-82
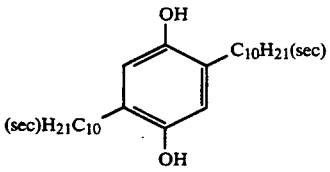
I-83
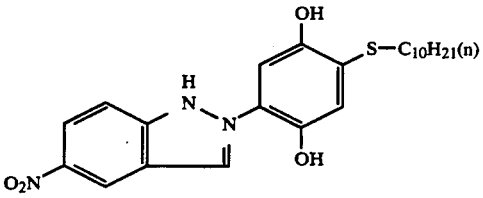
I-84
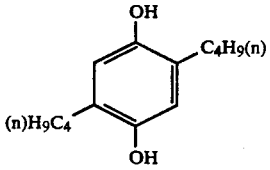
I-85
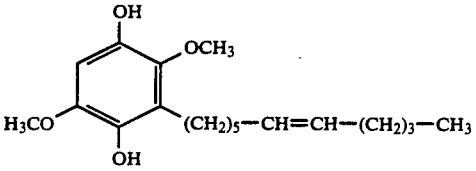
I-86
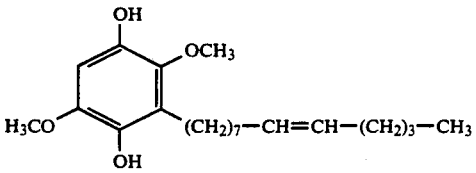

-continued
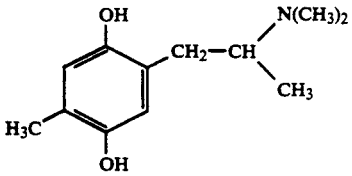
I-87
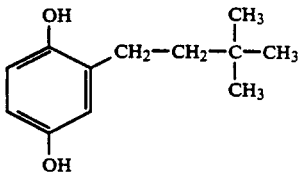
I-88
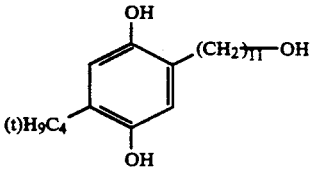
I-89
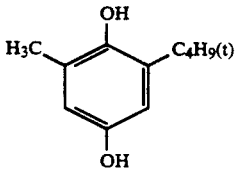
I-90
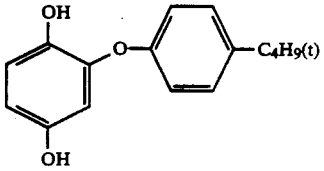
I-91
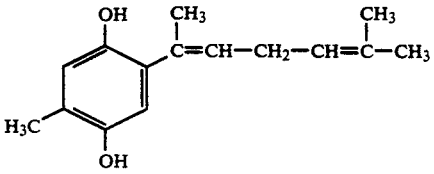
I-92
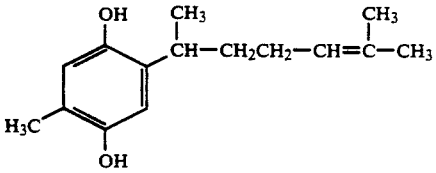
I-93
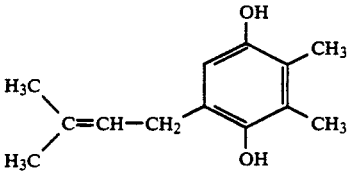
I-94
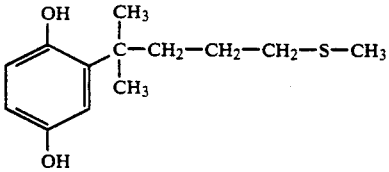
I-95
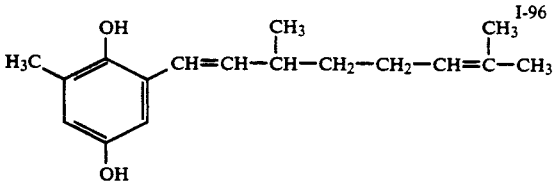
I-96
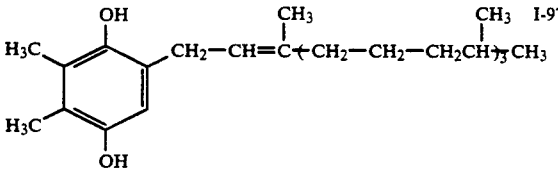
I-97
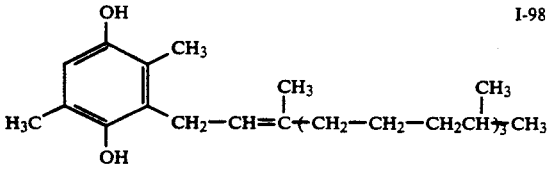
I-98
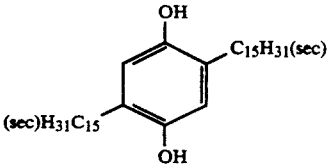
I-99
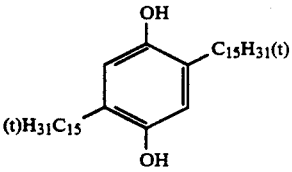
I-100
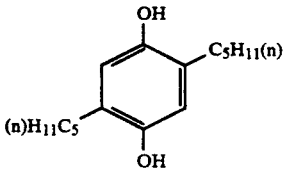
I-101

-continued
I-102
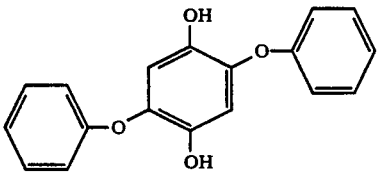
I-103
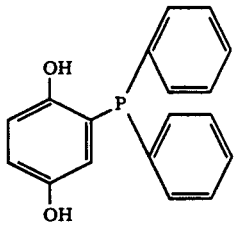
I-104
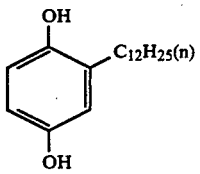
I-105
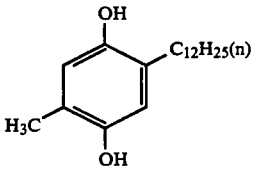
I-106
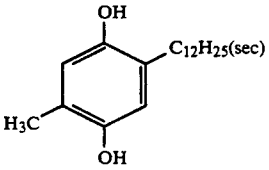
I-107
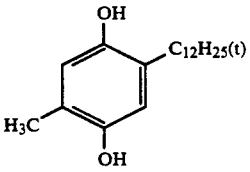
I-108
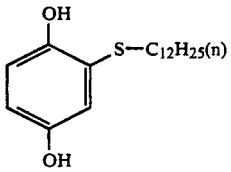
I-109
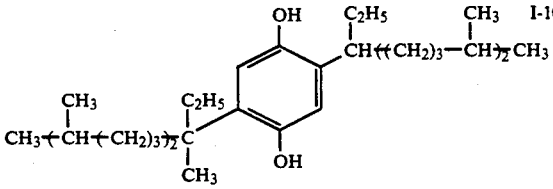
I-110
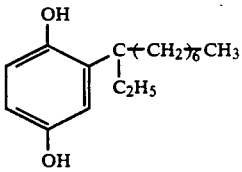
I-111
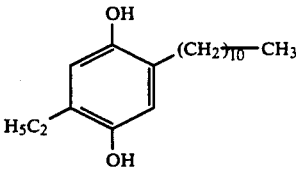
I-112
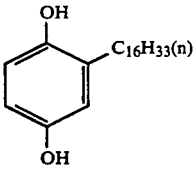
I-113
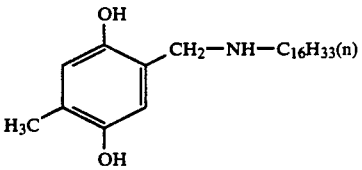
I-114
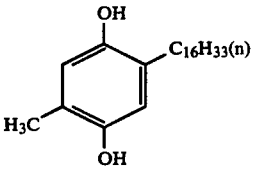
I-115
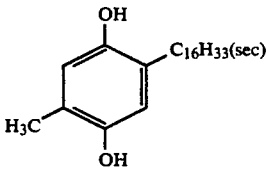
I-116
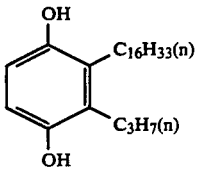
I-117
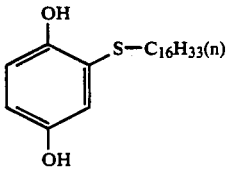

-continued
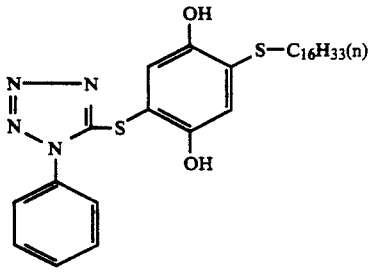
I-118
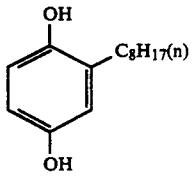
I-119
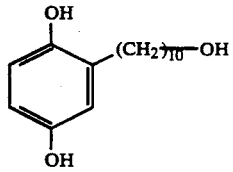
I-120
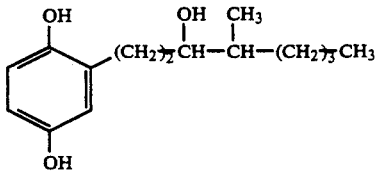
I-121
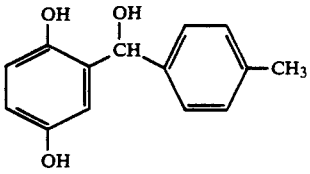
I-122
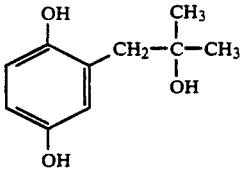
I-123
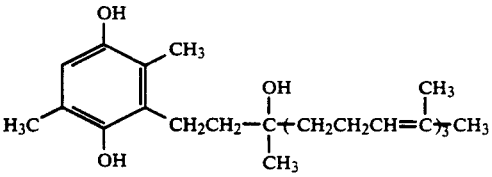
I-124
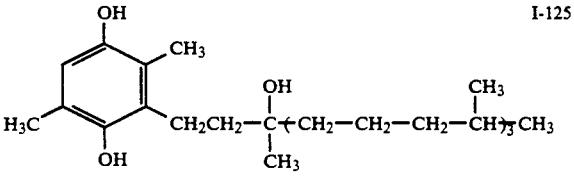
I-125
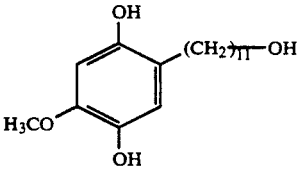
I-126
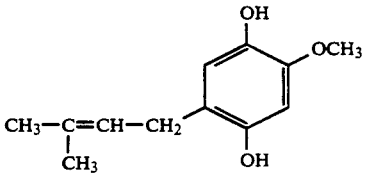
I-127
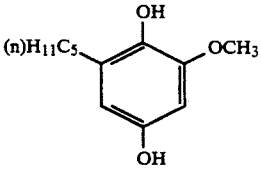
I-128
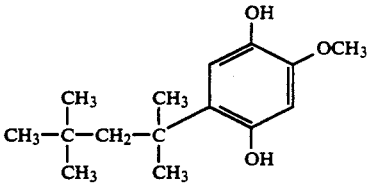
I-129
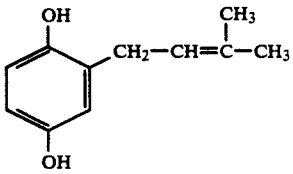
I-130
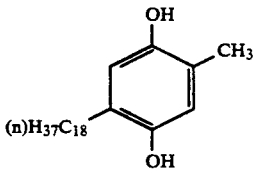
I-131
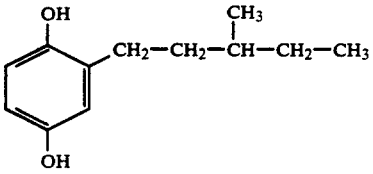
I-132
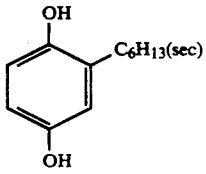
I-133

-continued
I-134
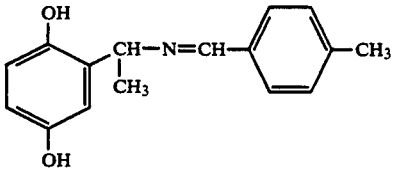
I-135
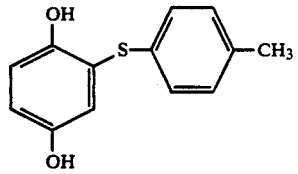
I-136
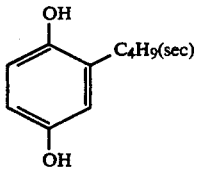
I-137
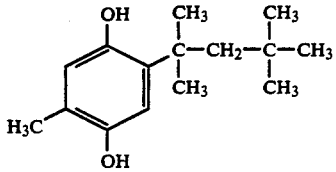
I-138
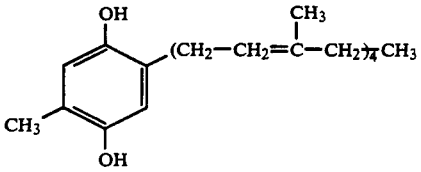
I-139
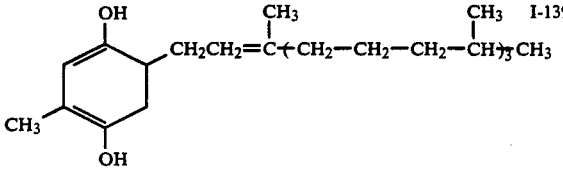
I-140
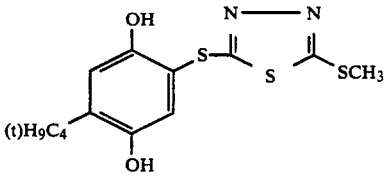
I-141
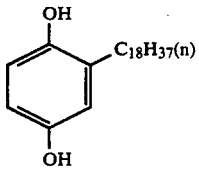
I-142
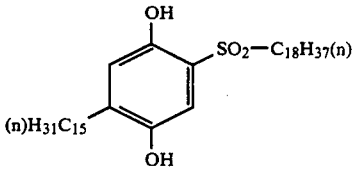
I-143
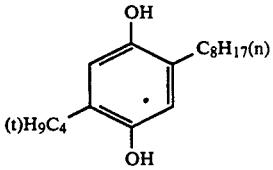
I-144
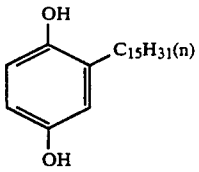
I-145
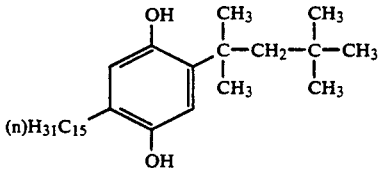
I-146
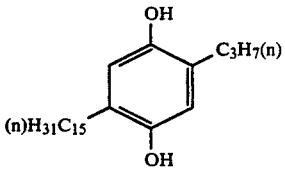
I-147
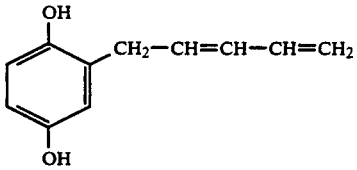
I-148
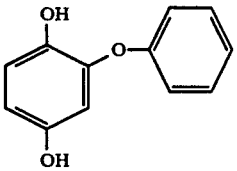
I-149
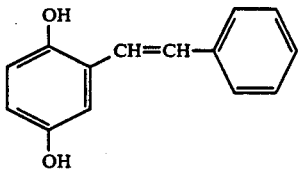
I-150
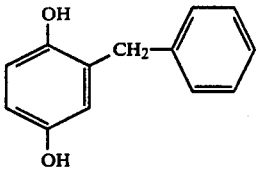
I-151
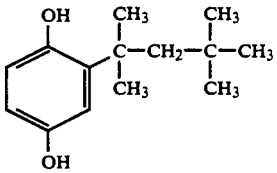

-continued
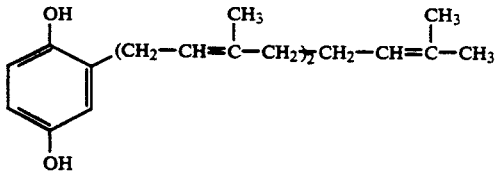
I-152
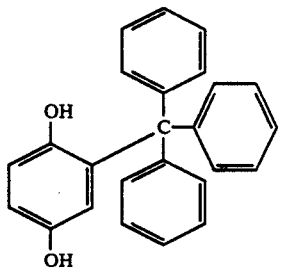
I-153
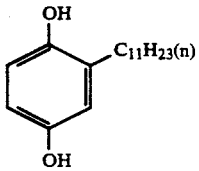
I-154
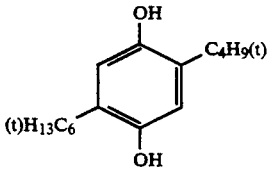
I-155
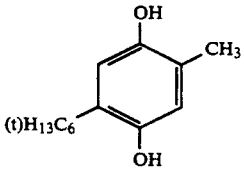
I-156
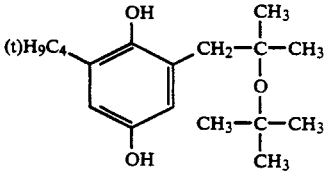
I-157
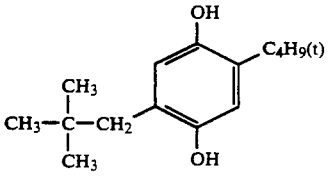
I-158
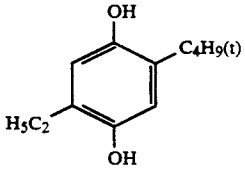
I-159
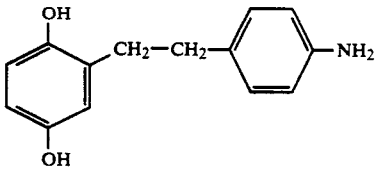
I-160
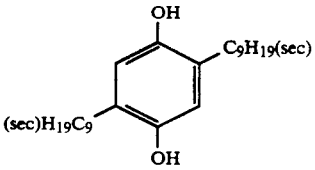
I-161
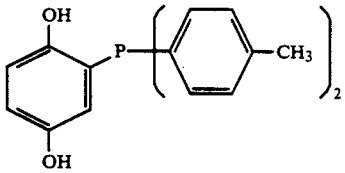
I-162
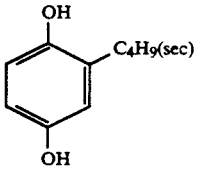
I-163
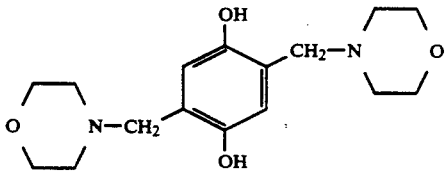
I-164
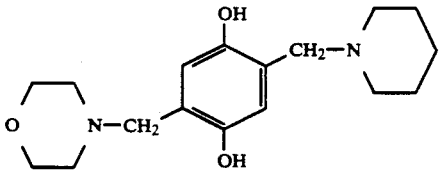
I-165
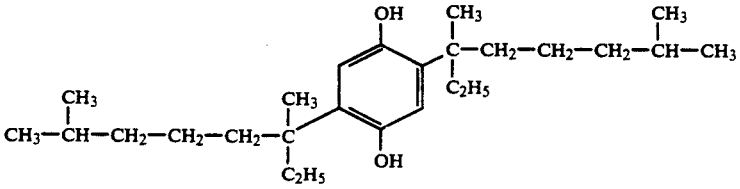
I-166

-continued
I-167
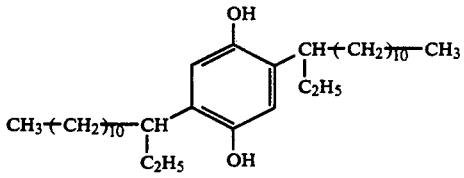
I-168
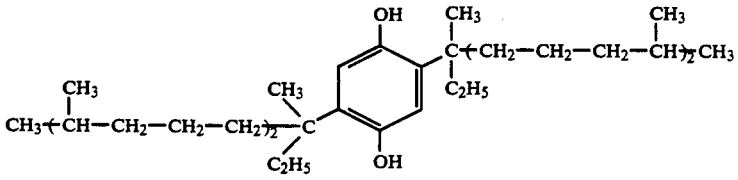
I-169
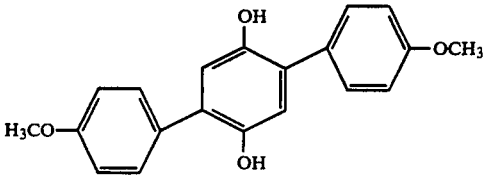
I-170
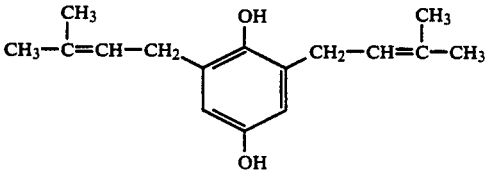
I-171
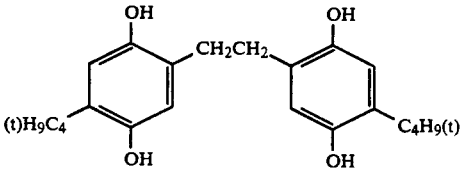
I-172
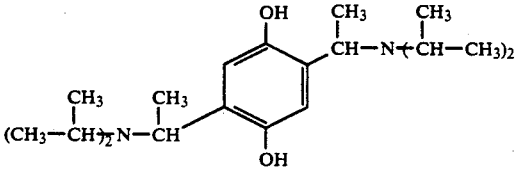
I-173
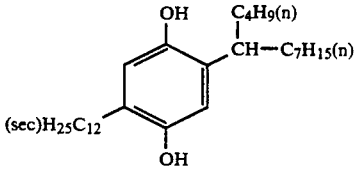
I-174
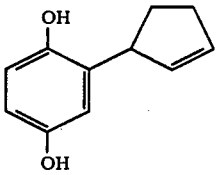
I-175
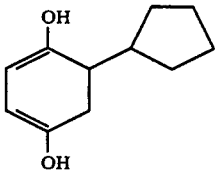
I-176
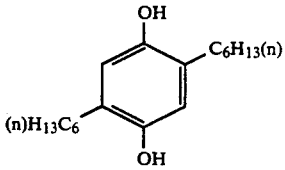
I-177
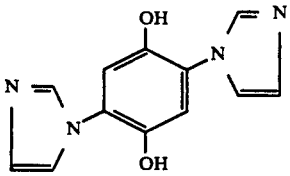
I-178
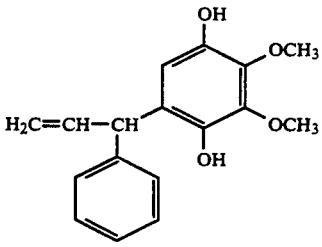
I-179
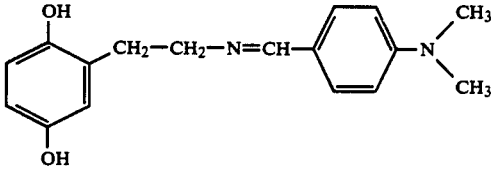
I-180
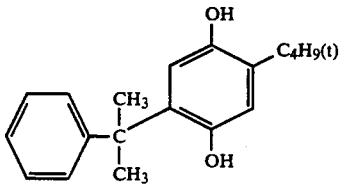

-continued
I-181
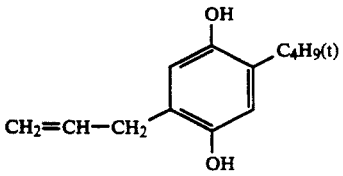
I-182
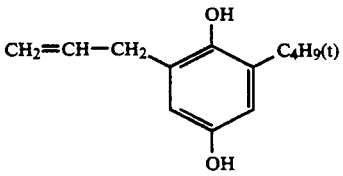
I-183
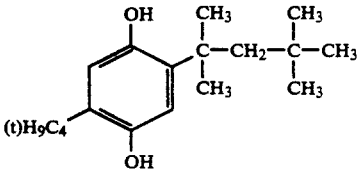
I-184
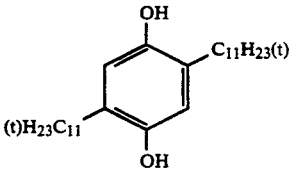
I-185
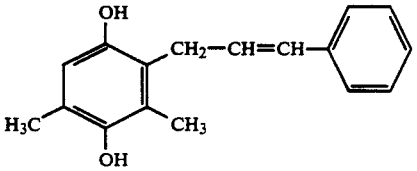
I-186
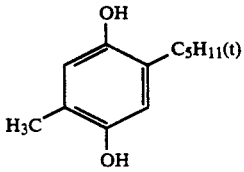
I-187
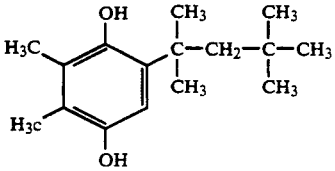
I-188
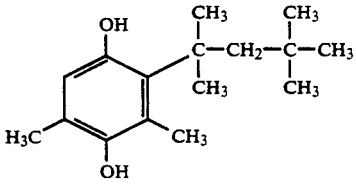
I-189
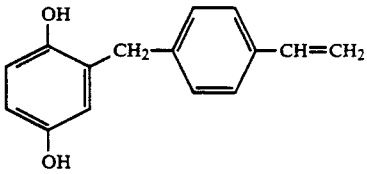
I-190
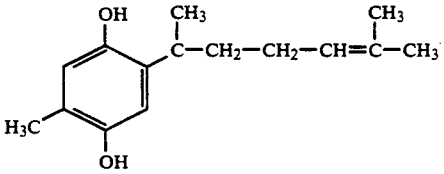
I-191
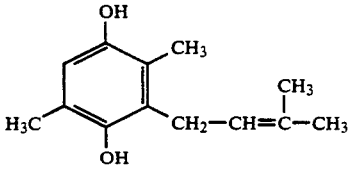
I-192
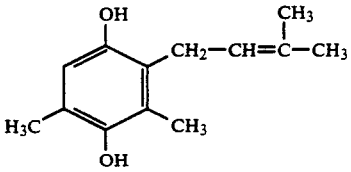
I-193
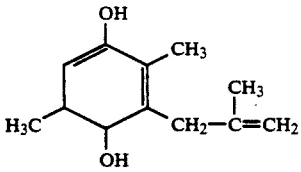
I-194
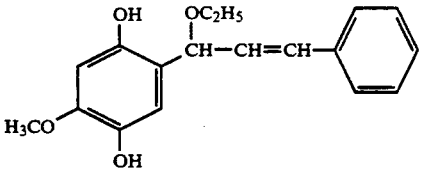
I-195
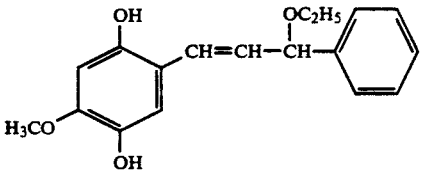
I-196
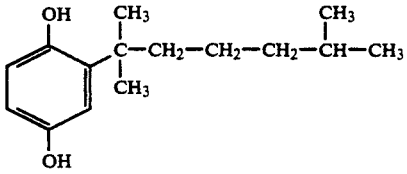
I-197
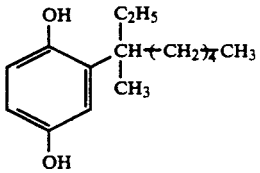
I-198
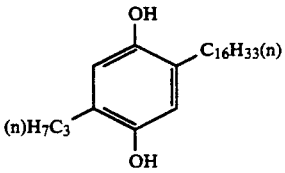

-continued
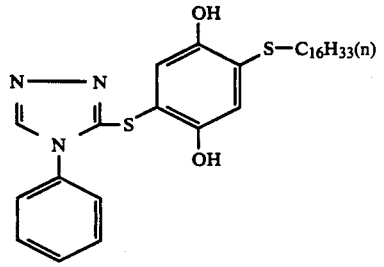
I-199
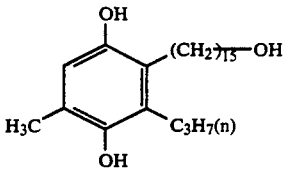
I-200
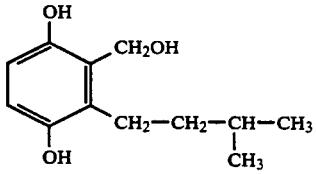
I-201
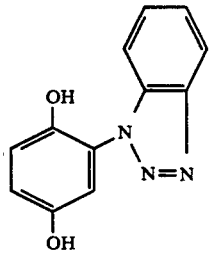
I-202
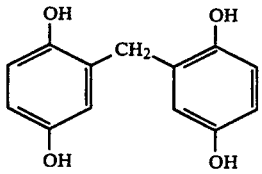
I-203
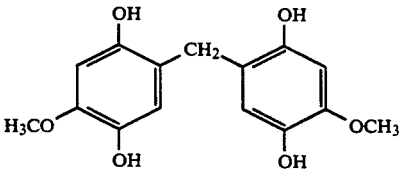
I-204
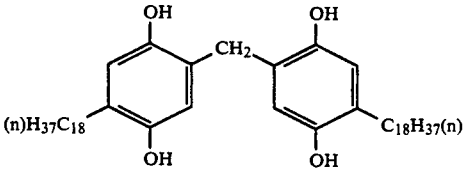
I-205
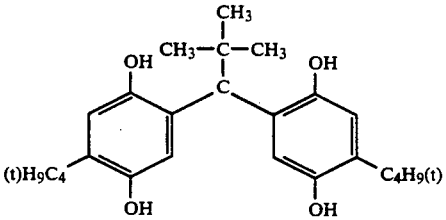
I-206
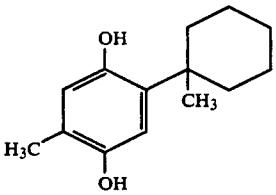
I-207
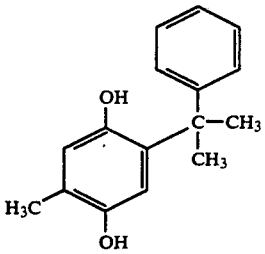
I-208
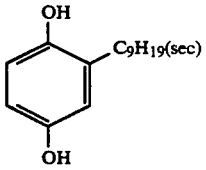
I-209
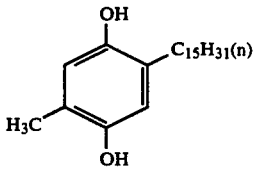
I-210
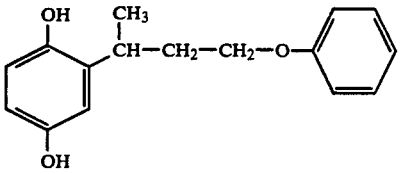
I-211
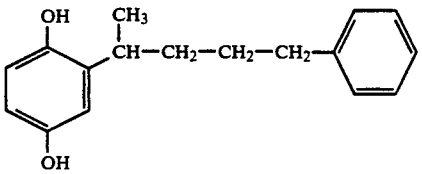
I-212

-continued
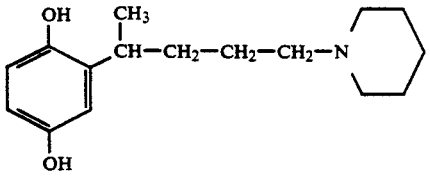
I-213
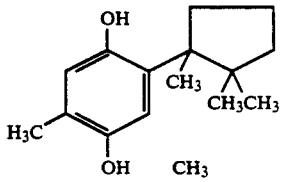
I-214
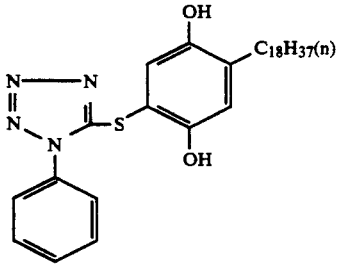
I-215
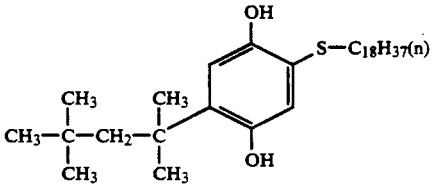
I-216
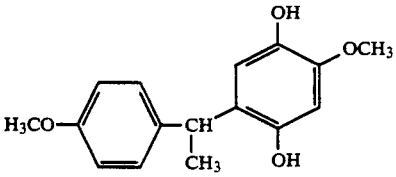
I-217
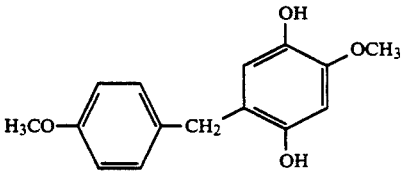
I-218
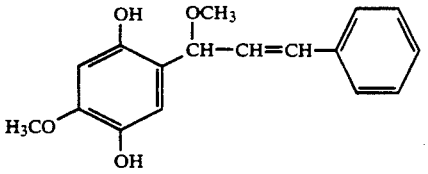
I-219
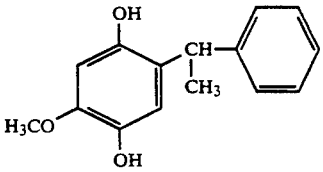
I-220
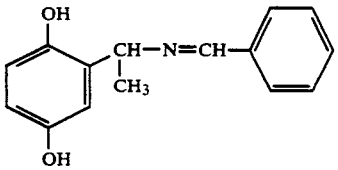
I-221
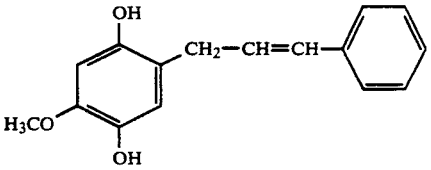
I-222
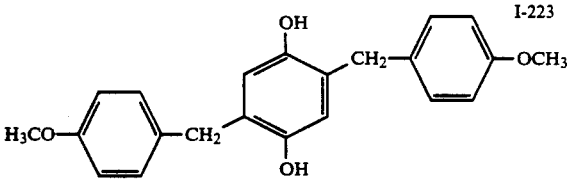
I-223
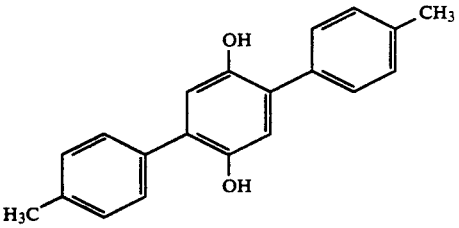
I-224
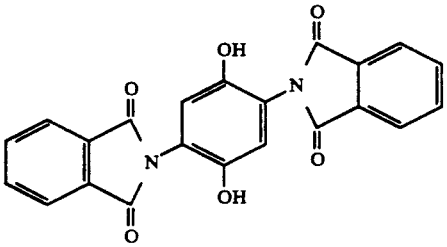
I-225
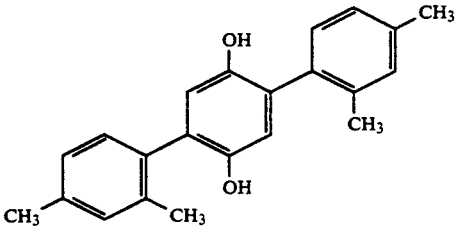
I-226

-continued
I-227
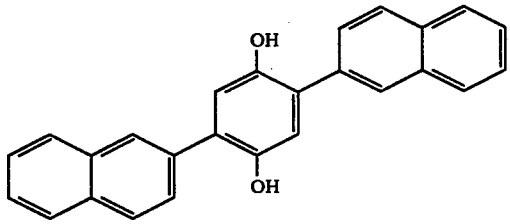
I-228
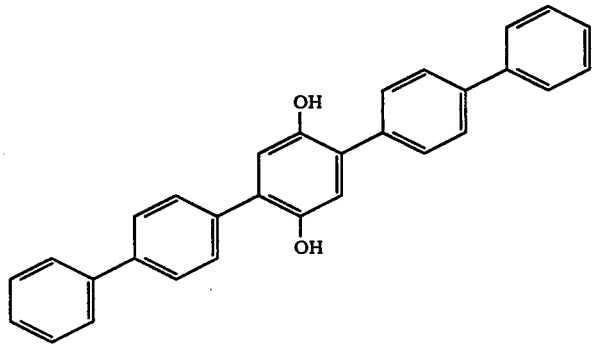
I-229
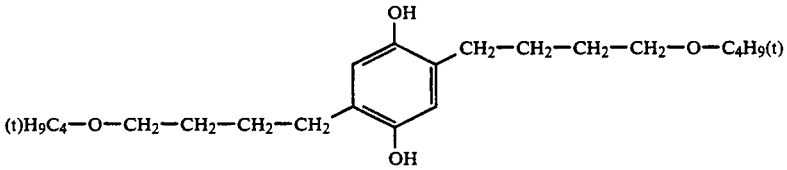
I-230
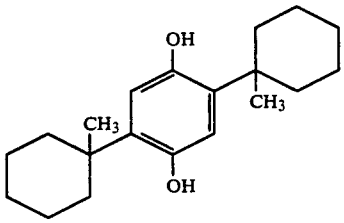
I-231
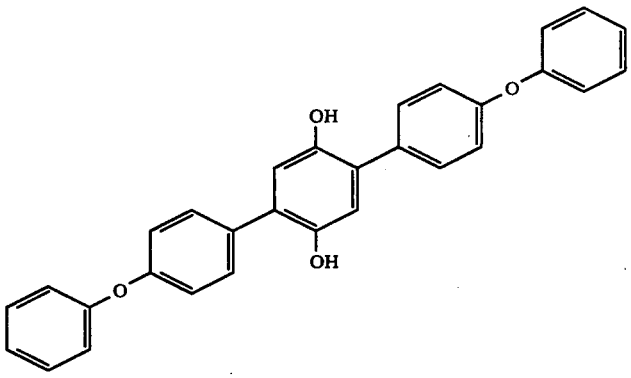
I-232
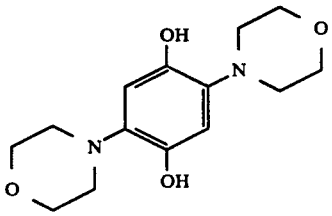
I-233
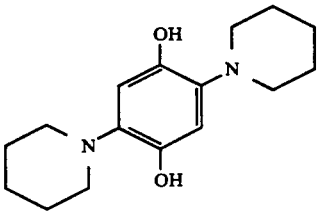

-continued
I-234
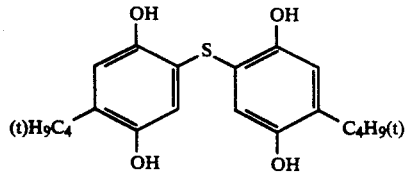
I-235
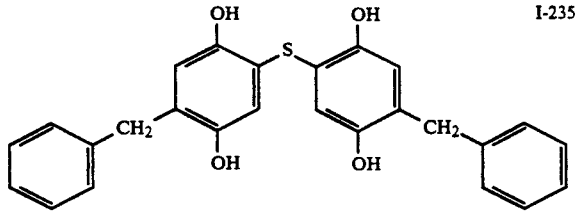
I-236
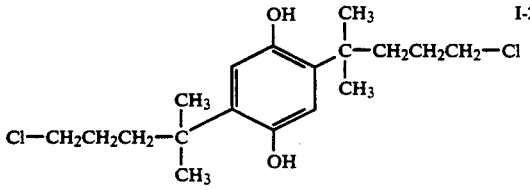
I-237
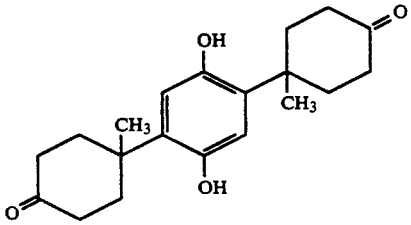
I-238
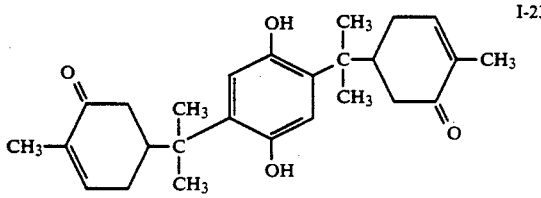
I-239
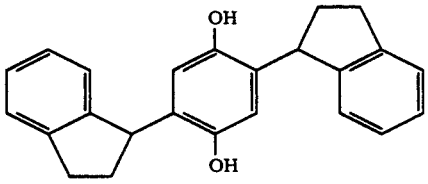
I-240
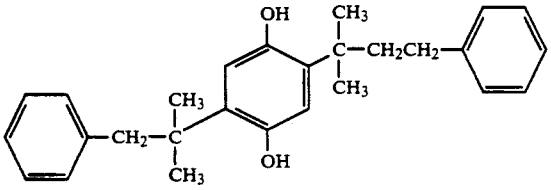
I-241
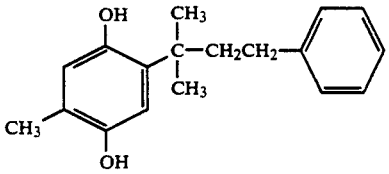
I-242
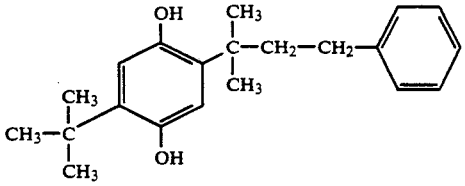
I-243
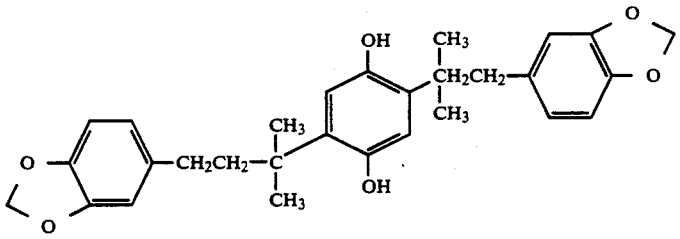
I-244
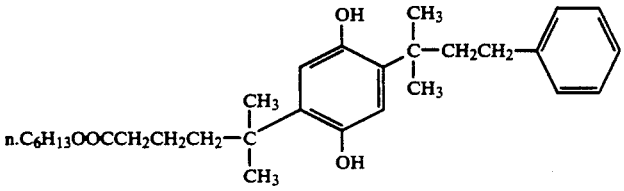

-continued
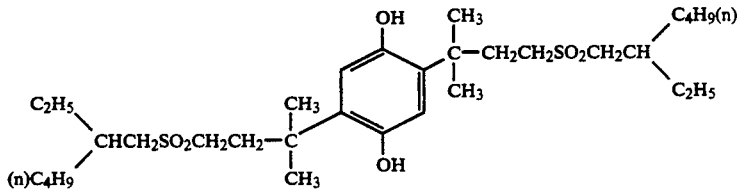
I-245
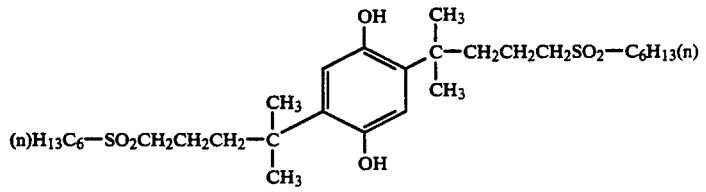
I-246
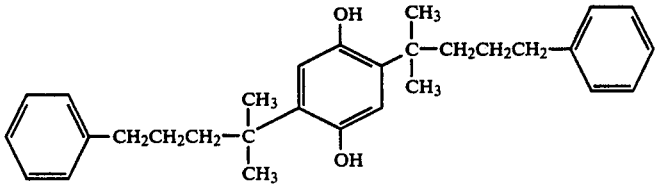
I-247
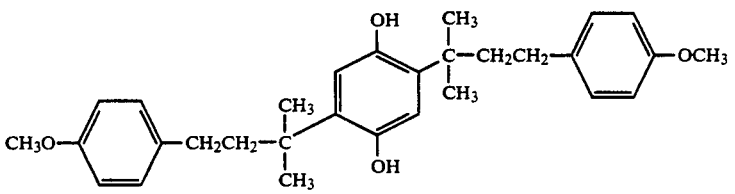
I-248
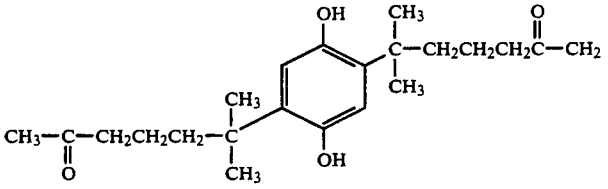
I-249
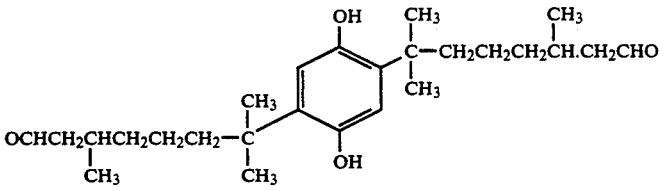
I-250
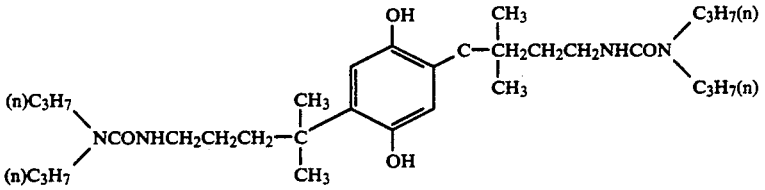
I-251
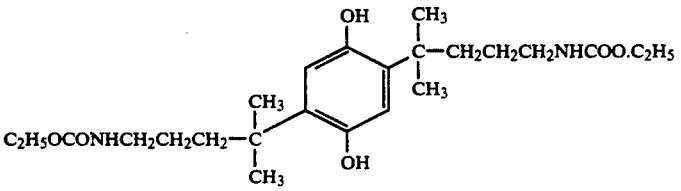
I-252

-continued
I-253
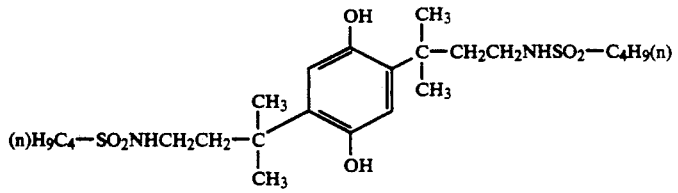
I-254
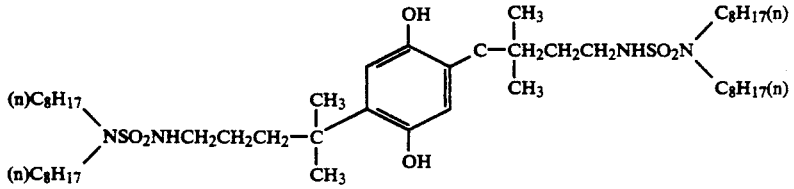
I-255
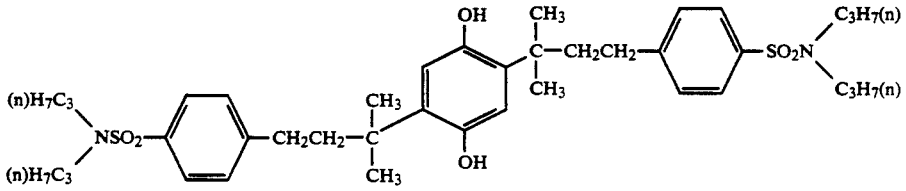
I-256
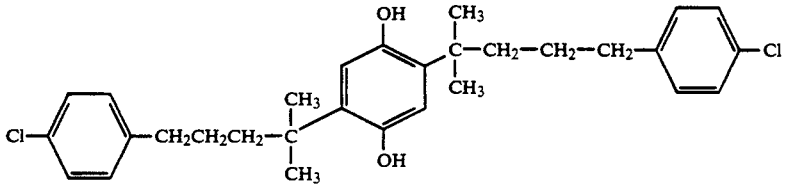
I-257
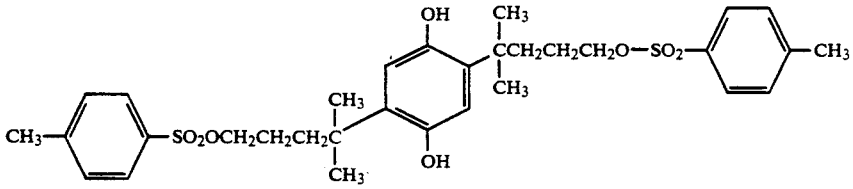
I-258
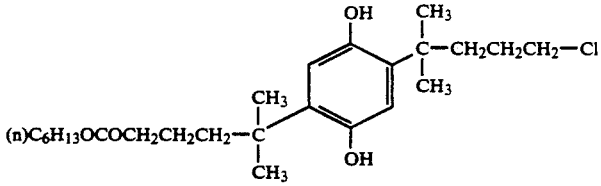
I-259
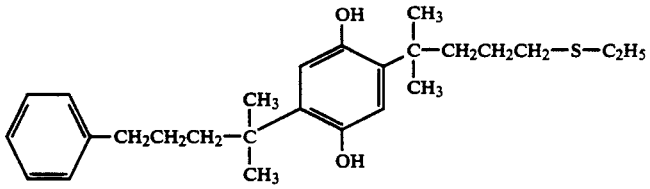
I-260
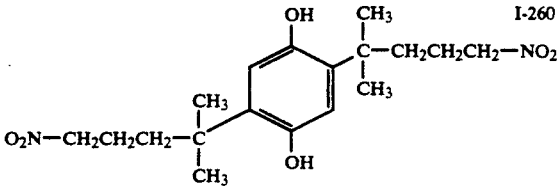
I-261
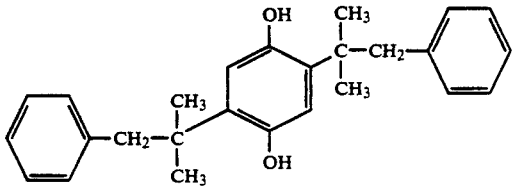

-continued
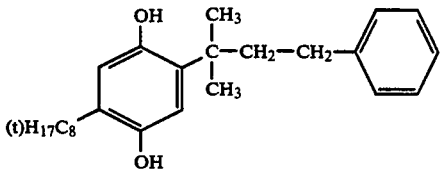
I-262
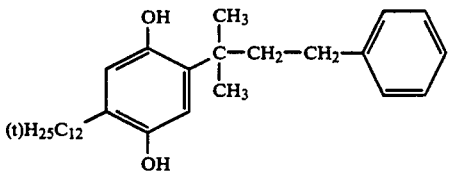
I-263
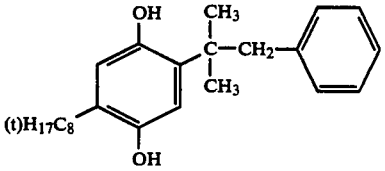
I-264
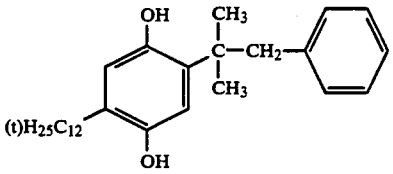
I-265
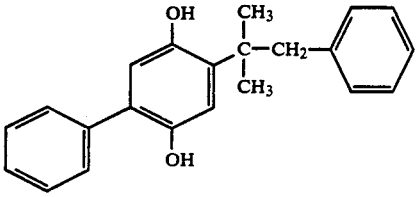
I-266
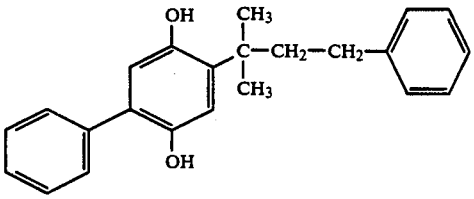
I-267
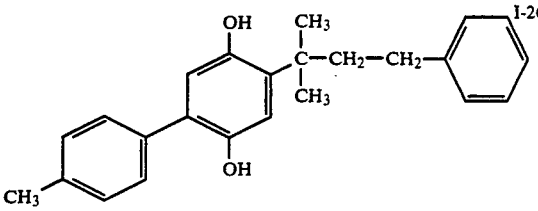
I-268
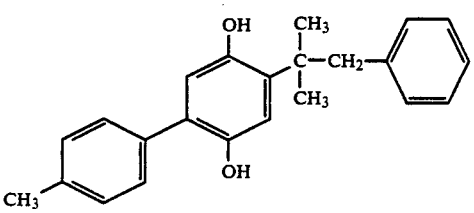
I-269
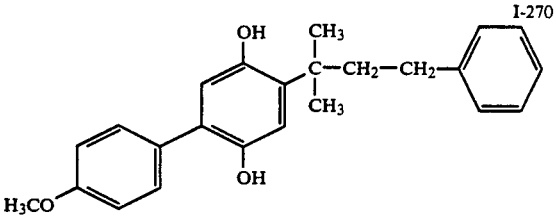
I-270
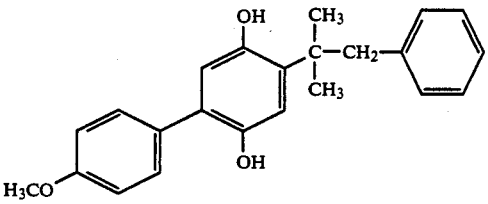
I-271
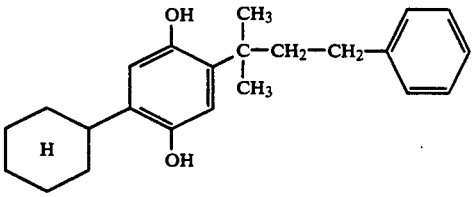
I-272
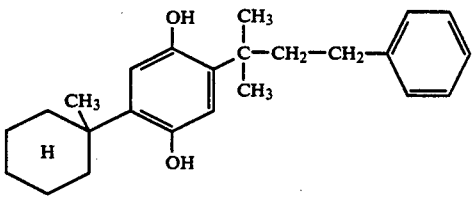
I-273
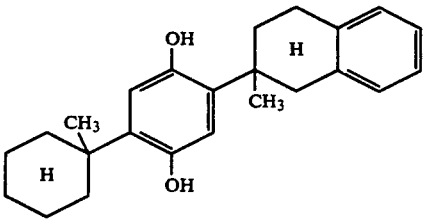
I-275
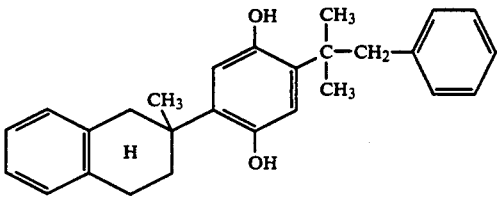
I-276

-continued
I-277
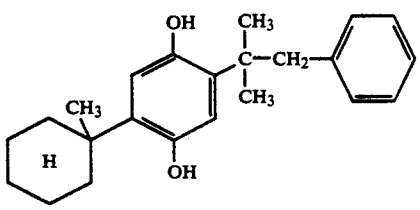
I-278
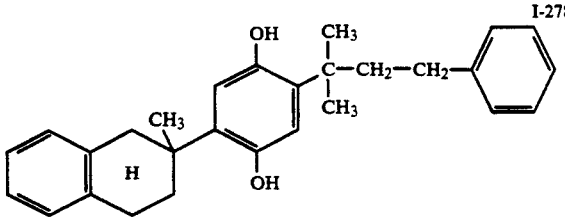
I-279
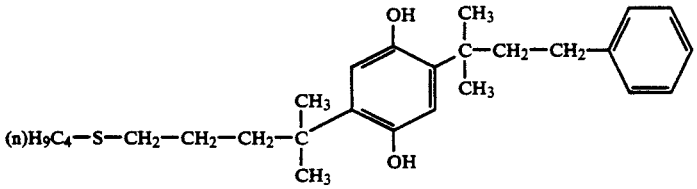
I-280
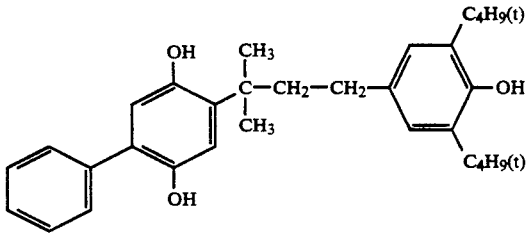
I-281
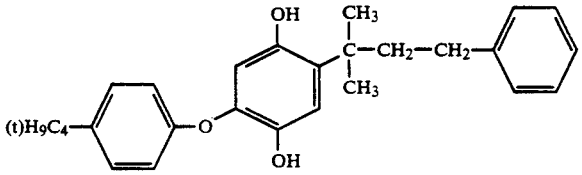
I-282
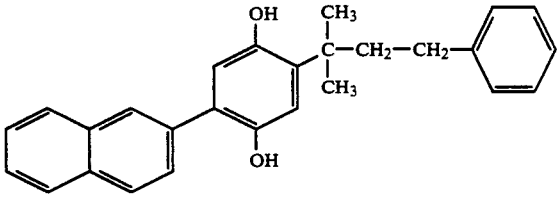
I-283
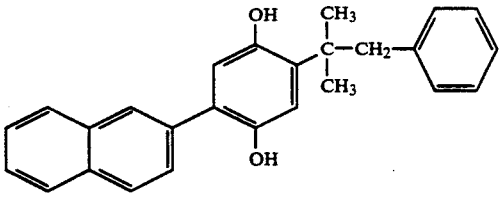
I-284
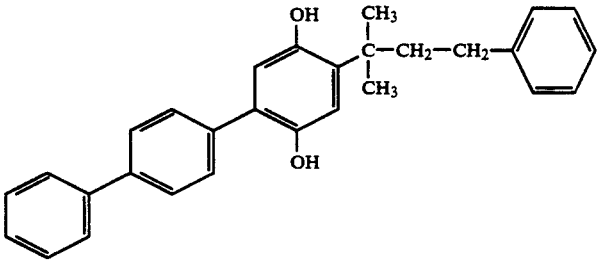

-continued
I-285
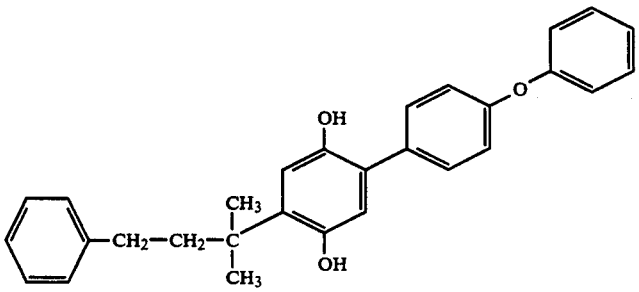
I-286
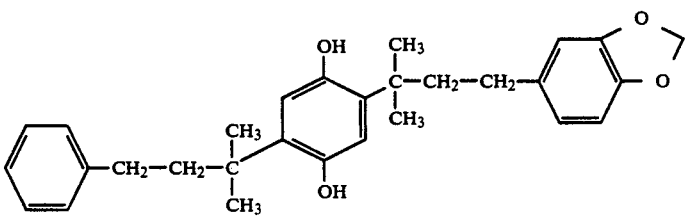
I-287
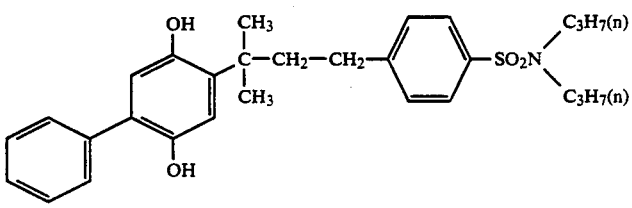
I-288
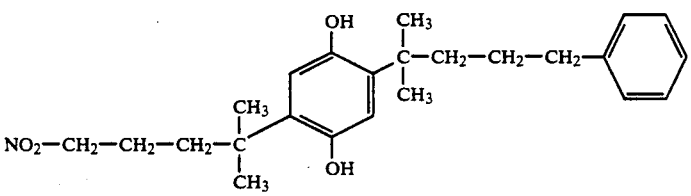
I-289
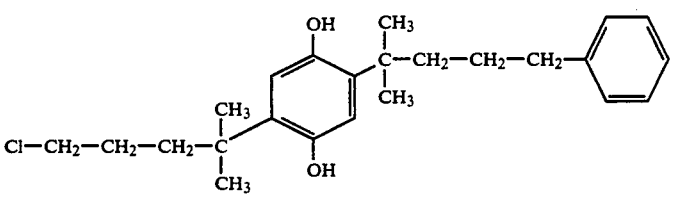
I-290
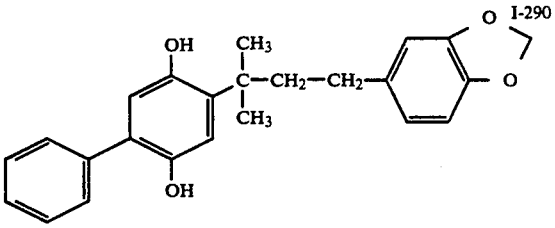
I-291
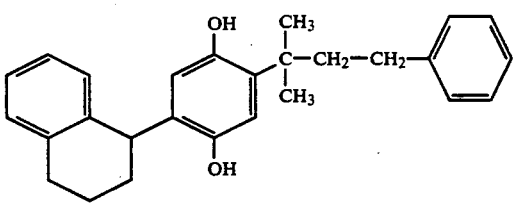
I-292
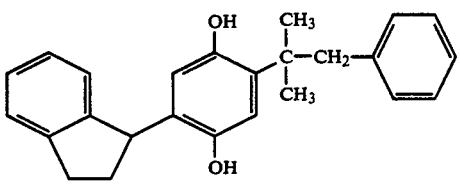
I-293
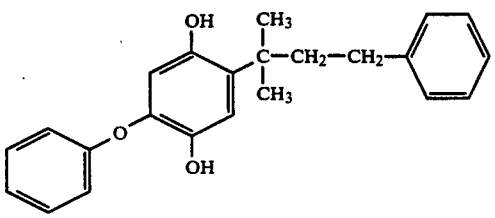

The reasons why the hydroquinone compounds for use in the present invention can impart the durability to the photoconductive layer may be as follows:

(1) The hydroquinone compounds are highly compatible with the materials, in particular a binder resin, contained in the photoconductive layer;

(2) do not react with the materials contained in the photoconductive layer;

(3) do not serve as a trap of charge carriers; and (4) promptly react with a free radical to prevent the production of the trap.

Since the hydroquinone compounds for use in the present invention have at least one group containing 4 or more, preferably 6 or more, carbon atoms, they are sufficiently compatible with the materials contained in the photoconductive layer. In addition, these compounds do not sublime during the production and the preservation of the photoconductor. In other words, they can stably exist in the photoconductive layer, so that they can effectively contribute to the improvement of the durability of the photoconductor.

It is preferable to employ a secondary antioxidant in combination with the hydroquinone compound from the viewpoints of preservability and resistance to heat. Various known phosphorus compounds and sulfur compounds can be used as the secondary antioxidant. Among them, phosphorus compounds are preferably employed in the present invention. Specific examples of the phosphorus compounds usable in the present invention are as follows:

tris(nonylphenyl)phosphite,
tris(p-tert-octylphenyl)phosphite,
tris[2,4,6-tris(α-phenylethyl)]phosphite,
tris(p-2-butenylphenyl)phosphite,
bis(p-nonylphenyl)cyclohexylphosphite,
tris(2,4-di-tert-butylphenyl)phosphite,
di(2,4-di-tert-butylphenyl)pentaerythritol diphosphite,
distearylpentaerythritol diphosphite,
4,4'-isopropylidene-diphenol alkylphosphite,
tetratridecyl-4,4'-butylidene-bis(3-methyl-6-tert-butylphenol)diphosphite.,
tetrakis(2,4-di-tert-butylphenyl)-4,4'-biphenylenediphosphite,
2,6-di-tert-butyl-4-methylphenyl.phenyl.pentaerythritol diphosphite,
2,6-di-tert-butyl-4-methylphenyl.methyl.pentaerythritol diphosphite,
2,6-di-tert-butyl-4-ethylphenyl.stearyl.pentaerythritol diphosphite,
di(2,6-di-tert-butyl-4-methylphenyl)pentaerythritol diphosphite, and
2,6-di-tert-amyl-4-methylphenyl.phenyl.pentaerythritol diphosphite.

The above phosphorus compounds can be used either singly or in combination.

Any inorganic and organic materials which can absorb light to produce charge carriers can be used as a charge generating material in the present invention.

Examples of the inorganic materials usable as a charge generating material include amorphous selenium, selenium with trigonal system, alloys of selenium and arsenic, alloys of selenium and tellurium, cadmium sulfide, zinc oxide and amorphous silicon.

Examples of the organic materials usable as a charge generating material include phthalocyanine pigments such as metallic phthalocyanine and non-metallic phthalocyanine, azulenium salt pigments, squaric methine pigments, azo pigments having a carbozole structure, azo pigments having a triphenylamine structure, azo pigments having a diphenylamine structure, azo pigments having a dibenzothiophene structure, azo pigments having an oxadiazole structure, azo pigments having a fluorenone structure, azo pigments having a bisstilbene structure, azo pigments having a distiryloxadiazole, azo pigments having a distirylcarbazole structure, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments and bisbenzimidazole pigments.

Examples of materials usable as a charge transporting material in the present invention include poly-N-vinylcarbazole and derivatives thereof, poly-γ-carbazolylethylglutamate and derivatives thereof, condensation products of pyrene and formaldehyde and derivatives thereof, polyvinyl pyrene, polyvinyl phenanthrene, oxazole derivatives, oxadiazole derivatives, imidazole derivatives, triphenylamine derivatives, 9-(p-diethylaminostyryl)anthracene, 1,1-bis(4-dibenzylaminophenyl)propane, styrylanthracene, styrylpyrazoline, phenylhydrazone, α-phenylstylbene derivatives, thiazole derivatives, triazole derivatives, phenazine derivatives, acridine derivatives, benzofuran derivatives, benzimidazole derivatives, and thiophene derivatives.

Among the above charge transporting materials, an aromatic amine compound having the following formula is preferable:

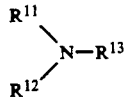

wherein $R^{11}$ and $R^{12}$ each are independently an aromatic group selected from a substituted or unsubstituted phenyl group, a naphtyl group and a polyphenyl group, and $R^{13}$ is a substituted or unsubstituted aryl group, an alkyl group, an alkoxyl group or a heterocyclic aromatic group.

Nonlimitative examples of the aromatic amine compound are as follows:

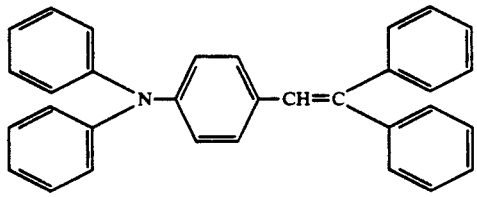

-continued
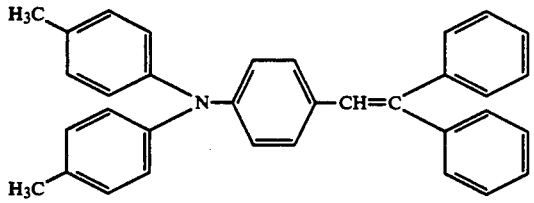
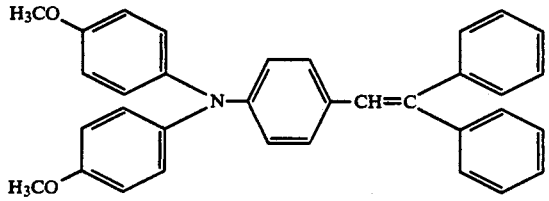
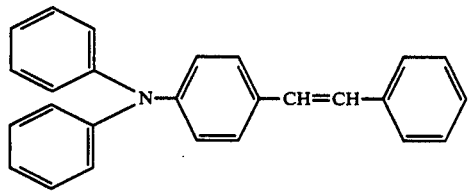
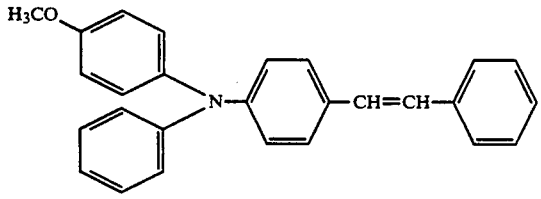
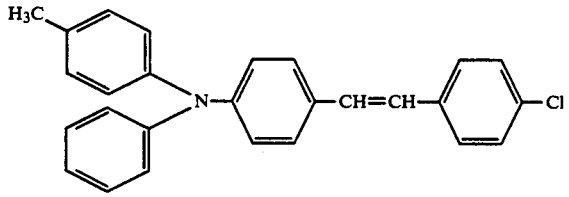
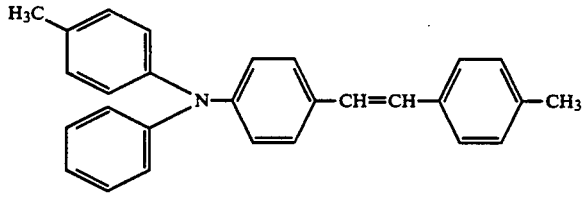
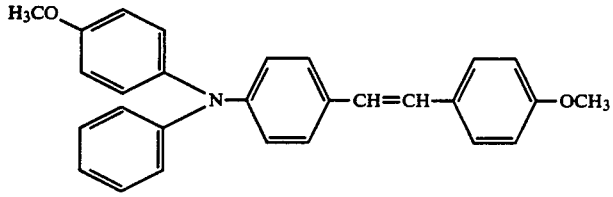

-continued
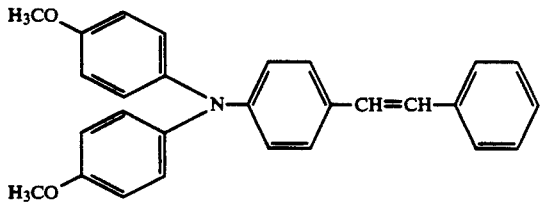
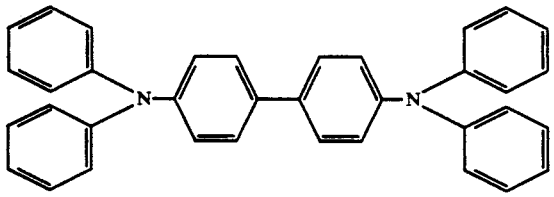
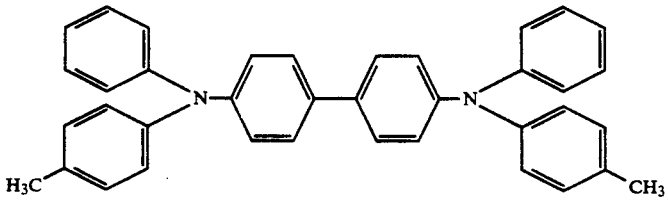
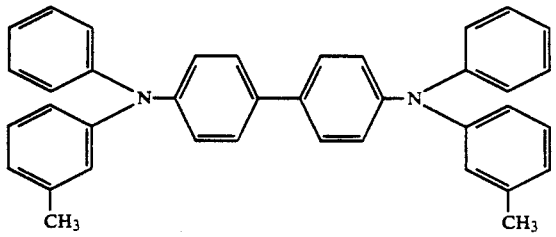
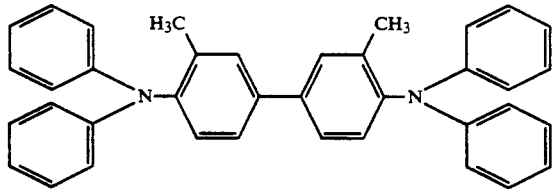
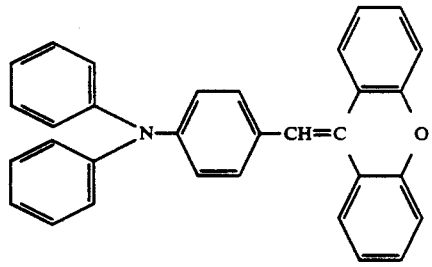
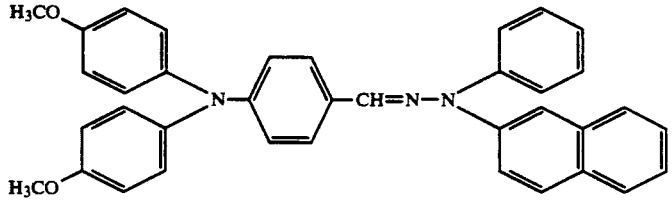

-continued

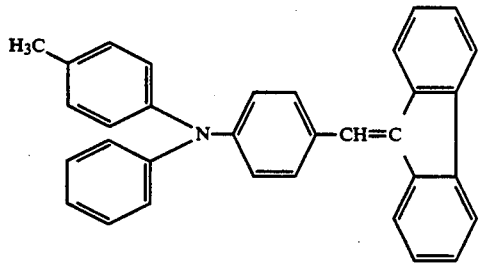

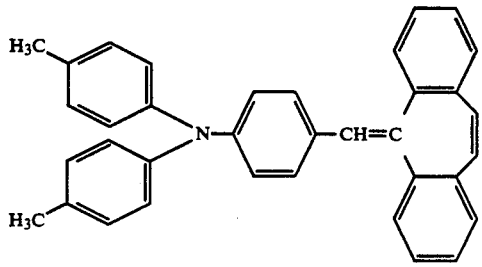

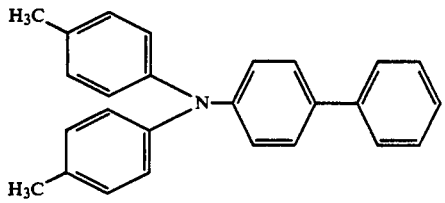

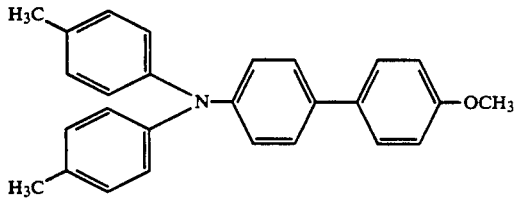

The photoconductive layer of the electrophotographic photoconductor according to the present invention may be of a mono-layered type or of a function-separated type.

In the case of the mono-layered type, a dispersion prepared by dispersing the charge generating material, the charge transporting material and the hydroquinone compound in a binder resin is applied to an electroconductive support to form a photoconductive layer.

In the case of the function-separated type, (a) a charge generating layer comprising the charge generating material and a binder resin is formed on an electroconductive support, and a charge transporting layer comprising the charge transporting material and a binder resin is then formed on the charge generating layer, or (b) the charge transporting layer is first formed on an electroconductive support and the charge generating layer is then formed on the charge transporting layer. The photoconductor of the above (a) type is of a negative-charging type, and the photoconductor of (b) type is of a positive-charging type.

The hydroquinone compound is incorporated into one of or both of the charge generating layer and the charge transporting layer.

In the function-separated-type photoconductor, the charge transporting material can be incorporated into the charge generating layer. In particular, the photosensitivity of the photoconductor of positively charging type can be greatly improved by doing so.

In order to improve the adhesion and the charge blocking properties, a non-photosensitive intermediate layer may be interposed between the electroconductive support and the photoconductive layer. Furthermore, a protective layer may be provided on the photoconductive layer so as to improve the resistance to wear and the mechanical durability.

Examples of the binder resin for use in the present invention include bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoyy resin. The above binder resins can be used either singly or in combination.

In the case of the photoconductor of negative-charging type (type (a)), the amount of the binder resin to be used in the charge generating layer is preferably 0 to 400 wt. % of the weight of the charge generating material. The thickness of the charge generating layer is preferably 0.1 to 5 μm. The amount of the binder resin to be used in the charge transporting layer is preferably 20 to 200 wt. % of the weight of the charge transporting material. The thickness of the charge transporting layer is preferably 5 to 50 μm.

In the case of the photoconductor of positive-charging type (type (b)), the amount of the binder resin to be used in the charge transporting layer is preferably 20 to 200 wt. % of the weight of the charge transporting material, and it is preferable to make the charge transporting layer 5 to 50 μm thick. The amount of the binder resin to be used in the charge generating layer is preferably 10 to 500 wt. % of the weight of the charge generating material. Moreover, it is preferable to incorporate the charge transporting material into the charge generating layer. By doing so, the rise of the residual potential can be minimized and the sensitivity can be enhanced. The amount of the charge transporting material incorporated into the charge generating layer is preferably 20 to 200 wt. % of the weight of the binder resin contained in the charge generating layer. The thickness of the charge generating layer is 0.1 to 10 μm.

The incorporation amount of the hydroquinone compound is preferably 0.01 to 10.0 wt. % of the weight of the charge transporting material when it is incorporated into the charge transporting layer, and preferably 0.1 to 20.0 wt. % of the weight of the charge generating material when incorporated into the charge generating layer.

In the case of the mono-layered type photoconductor, the amount of the charge transporting material is preferably 50 to 150 wt. % of the weight of the binder resin, and the amount of the charge generating material is preferably 10 to 50 wt. % of the weight of the binder resin. The thickness of the photoconductive layer is preferably 5 to 50 μm. The incorporation amount of the hydroquinone compound is preferably 0.01 to 5.0 wt. % of the weight of the charge transporting material contained in the photoconductive layer.

The previously-mentioned non-photosensitive intermediate layer comprises a resin as a main component. It is preferable that the resin be highly resistant to an ordinary organic solvent because a solvent is employed when the photoconductive layer is formed on the intermediate layer.

Examples of the resin for use in the intermediate layer include water-soluble resins such as polyvinyl alcohol, casein and sodium polyacrylate, alcohol-soluble resins such as copolymerized nylon and methoxymethylated nylon, and hardened resins having a three-dimensional network such as polyurethane, a melamine resin, a phenol resin, an alkydmelamine resin and an epoxy resin.

Furthermore, fine powder of a metal oxide such as titanium oxide, silica, alumina, zirconium oxide, tin oxide or indium oxide may be incorporated into the intermediate layer. When the intermediate layer contains such fine powder, a Moiré-image is not produced, and the rise of the residual potential is also restrained.

As a dispersing medium for the components of the photoconductive layer, the following solvents can be employed: N,N'-dimethylformamide, acetone, methyl ethyl ketone, cyclohexanone, benzene, toluene, xylene, chloroform, 1,2-dichloroethane, dichloromethane, monochlorobenzene, tetrahydrofuran, dioxane, methanol, ethanol, isopropanol, ethylacetate, butylacetate and dimethylsulfoxide.

The photoconductive layer can be formed by means of dip coating or spray coating.

The electroconductive support for use in the present invention may be a drum or sheet of a metal such as aluminum, brass, stainless steel or nickel. A sheet- or cylinder-shaped plastic film such as polyethylene terephthalate, polypropylene or nylon, or paper on which a metal such as aluminum or nickel is deposited, or to which an electroconductive material such as titanium oxide, tin oxide or carbon black is applied along with a binder may also be used as the support.

Other features of this invention will become apparent in the course of the following description of exemplary embodiments, which are given for illustration of the invention and are not intended to be limiting thereof.

EXAMPLE 1

15 parts by weight of an alkyd resin (Trademark "Beckosol 1307-60-EL" made by Dainippon Ink & Chemicals, Inc.) and 10 parts by weight of a melamine resin (Trademark "Superbeckamine G-821-60" made by Dainippon Ink & Chemicals, Inc.) were dissolved in 150 parts by weight of methyl ethyl ketone. To the resulting solution, 90 parts by weight of titanium oxide (Trademark "Tipaque CR-EL" made by Ishihara Sangyo Kaisha, Ltd.) was added and dispersed for 12 hours by a ball mill, thereby obtaining a coating liquid for forming an intermediate layer.

The above-prepared coating liquid was coated onto the surface of an aluminum plate with a thickness of 0.2 mm (Trademark "A1080" made by Sumitomo Light Metal Industries, Ltd.), and then dried at 140° C. for 20 minutes to form an intermediate layer with a thickness of 2 μm.

4 parts by weight of a polyvinyl butyral resin (Trademark "S-Lec BL-S" made by Sekisui Chemical Co., Ltd.) was dissolved in 150 parts by weight of cyclohexanone, to which 10 parts by weight of a trisazo pigment having formula [a] was added and dispersed for 48 hours by a ball mill.

[a]

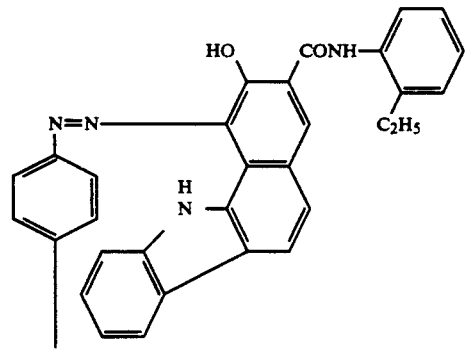

-continued

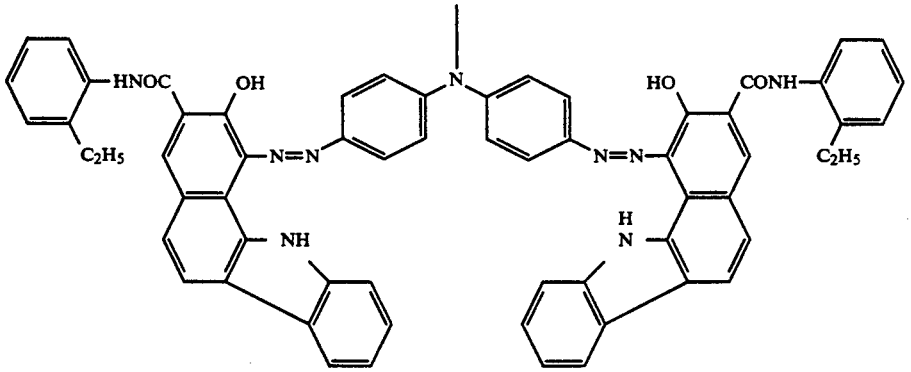

210 parts by weight of cyclohexanone was further added to the above-obtained dispersion and dispersed for 3 hours. The resulting dispersion was diluted with cyclohexanone to obtain a coating liquid for forming a charge generating layer with a solid content of 1.5 wt. %. The coating liquid thus obtained was applied to the intermediate layer and then dried at 130° C. for 20 minutes, thereby forming a charge generating layer with a thickness of 0.2 μm.

10 parts by weight of a polycarbonate resin (Trademark "Panlite K-1300" made by Teijin Limited) and 0.002 parts by weight of silicone oil (Trademark "KF-50" made by Shin-Etsu Chemical Co., Ltd.) were dissolved in 83 parts by weight of methylene chloride, to which were added 7 parts by weight of a charge transporting material having formula [b] and 0.04 parts by weight of Compound No. I-5, thereby obtaining a coating liquid for forming a charge transporting layer.

[b]

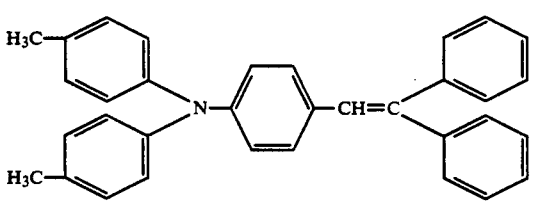

The above-obtained coating liquid was coated onto the charge generating layer and then dried at 130° C. for 20 minutes, thereby forming a charge transporting layer with a thickness of 20 μm.

Thus, electrophotographic photoconductor No. 1 according to the present invention was obtained.

EXAMPLE 2

The procedure for Example 1 was repeated except that Compound No. I-5 used in the coating liquid for forming the charge transporting layer in Example 1 was replaced by Compound No. I-30, whereby electrophotographic photoconductor No. 2 according to the present invention was obtained.

EXAMPLE 3

The procedure for Example 1 was repeated except that Compound No. I-5 used in the coating liquid for forming the charge transporting layer in Example 1 was replaced by Compound No. I-61, whereby electrophotographic photoconductor No. 3 according to the present invention was obtained.

EXAMPLE 4

The procedure for Example 1 was repeated except that Compound No. I-5 used in the coating liquid for forming the charge transporting layer in Example 1 was replaced by Compound No. I-82, whereby electrophotographic photoconductor No. 4 according to the present invention was obtained.

EXAMPLE 5

The procedure for Example 1 was repeated except that Compound No. I-5 used in the coating liquid for forming the charge transporting layer in Example 1 was replaced by Compound No. I-54, whereby electrophotographic photoconductor No. 5 according to the present invention was obtained.

EXAMPLE 6

The procedure for Example 1 was repeated except that Compound No. I-5 used in the coating liquid for forming the charge transporting layer in Example 1 was replaced by Compound No. I-261, whereby electrophotographic photoconductor No. 6 according to the present invention was obtained.

EXAMPLE 7

The procedure for Example 1 was repeated except that Compound No. I-5 used in the coating liquid for forming the charge transporting layer in Example 1 was replaced by Compound No. I-267, whereby electrophotographic photoconductor No. 7 according to the present invention was obtained.

EXAMPLE 9

The procedure for Example 1 was repeated except that Compound No. I-5 used in the coating liquid for forming the charge transporting layer in Example 1 was replaced by Compound No. I-36, whereby electrophotographic photoconductor No. 9 according to the present invention was obtained.

COMPARATIVE EXAMPLE 1

The procedure for Example 1 was repeated except that Compound No. I-5 used in the coating liquid for forming the charge transporting layer in Example 1 was eliminated therefrom, whereby comparative electrophotographic photoconductor No. 1 was obtained.

COMPARATIVE EXAMPLE 2

The procedure for Example 1 was repeated except that 0.04 parts by weight of Compound No. I-5 used in the coating liquid for forming the charge transporting layer in Example 1 was replaced by 0.07 parts by weight of Comparative Compound 1 (Trademark "Sumirizer MDP-S" made by Sumitomo Chemical Co., Ltd.) having the following formula, whereby comparative electrophotographic photoconductor No. 2 was obtained.

(Comparative Compound No. 1)

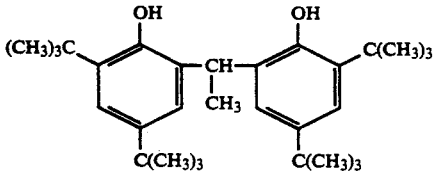

COMPARATIVE EXAMPLE 3

The procedure for Example 1 was repeated except that 0.04 parts by weight of Compound No. I-5 used in the coating liquid for forming the charge transporting layer in Example 1 was replaced by 0.07 parts by weight of Comparative Compound No. 2 (Trdemark "Sumirizer TPM" made by Sumitomo Chemical Co., Ltd.) having the following formula, whereby comparative electrophotographic photoconductor No. 3 was obtained.

(Comparative Compound No. 2)

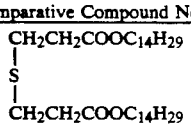

COMPARATIVE EXAMPLE 4

The procedure for Example 1 was repeated except that 0.04 parts by weight of Compound No. I-5 used in the coating liquid for forming the charge transporting layer in Example 1 was replaced by 0.07 parts by weight of Comparative Compound No. 3 (Trademark "MARK PEP-24" made by Adeka Argus Chemical Co., Ltd.) having the following formula, whereby comparative electrophotographic photoconductor No. 4 was obtained.

(Comparative Compound No. 3)

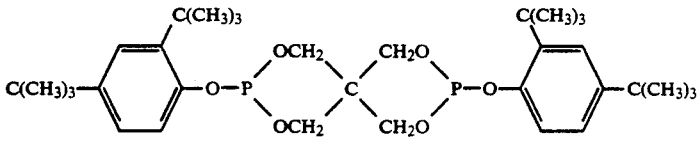

COMPARATIVE EXAMPLE 5

The procedure for Example 1 was repeated except that 0.04 parts by weight of Compound No. I-5 used in the coating liquid for forming the charge transporting layer in Example 1 was replaced by 0.07 parts by weight of Comparative Compound No. 4 having the following formula, whereby comparative electrophotographic photoconductor No. 5 was obtained.

(Comparative Compound No. 4)

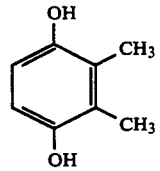

EXAMPLE 1

3 parts by weight of an alcohol-soluble polyamide (Trademark "CM-8000" made by Toray Industries, Ltd.) was dissolved in 100 parts by weight of a 8:2 mixed solvent of methyl alcohol and n-butyl alcohol under heating to prepare a coating liquid for forming an intermediate layer.

The above-obtained coating liquid was coated onto the surface of an aluminum plate with a thickness of 0.2 mm (Trademark "CA1080" made by Sumitomo Light Metal Industires, Ltd.) and then dried at 120° C. for 10 minutes, thereby forming an intermediate layer with a thickness of 0.2 μm.

4 parts by weight of a polyvinyl butyral resin (Trademark "XYHL" made by Union Carbide Japan K. K.) was dissolved in 150 parts by weight of cyclohexanone. To the resulting solution, 10 parts by weight of a disazo pigment having the following formula [c] was added and dispersed for 48 hours by a ball mill.

[c]

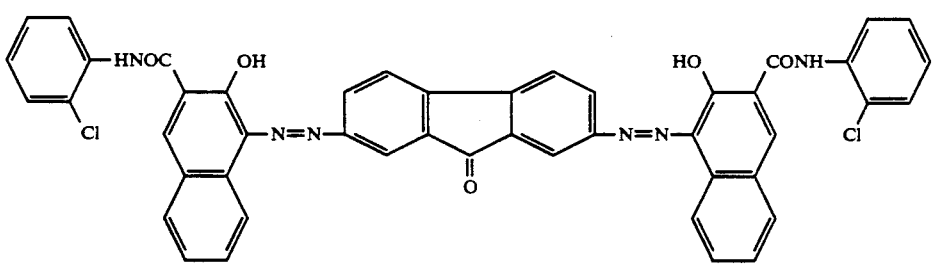

Thereafter, 210 parts by weight of cyclohexanone was further added to the above-prepared dispersion, and dispersed for 3 hours by the ball mill. The resulting dispersion was diluted with cyclohexanone under stirring to obtain a coating liquid for forming a charge generating layer with a solid content of 1.0 wt. %. The coating liquid thus obtained was coated onto the intermediate layer by means of dip coating and then dried at 120° C. for 10 minutes, thereby forming a charge generating layer with a thickness of 0.2 μm.

10 parts by weight of a polycarbonate resin (Trademark "Panlite K-1300" made by Teijin Limited) and 0.002 parts by weight of silicone oil (Trademark "KF-50" made by Shin-Etsu Chemical Co., Ltd.) were dissolved in 85 parts by weight of methylene chloride, to which were dissolved 9 parts by weight of a charge transporting material having the following formula [d] and 0.04 parts by weight of Compound No. I-5, thereby obtaining a coating liquid for forming a charge transporting layer.

[d]

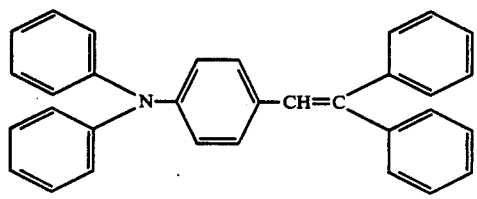

The above-obtained coating liquid was coated onto charge generating layer and dried at 130° C. for 20 minutes, thereby forming a charge transporting layer with a thickness of 20 μm.

Thus, electrophotographic photoconductor No. 10 according to the present invention was prepared.

EXAMPLE 11

The procedure for Example 10 was repeated except that Compound No. I-5 used in the coating liquid for forming the charge transporting layer in Example 10 was replaced by Compound No. I-61, whereby electrophotographic photoconductor No. 11 according to the present invention was prepared.

EXAMPLE 12

The procedure for Example 10 was repeated except that Compound No. I-5 used in the coating liquid for forming the charge transporting layer in Example 10 was replaced by Compound No. I-82, whereby electrophotographic photoconductor No. 12 according to the present invention was prepared.

EXAMPLE 13

The procedure for Example 10 was repeated except that Compound No. I-5 used in the coating liquid for forming the charge transporting layer in Example 10 was replaced by Compound No. I-54, whereby electrophotographic photoconductor No. 13 according to the present invention was prepared.

EXAMPLE 14

The procedure for Example 10 was repeated except that Compound No. I-5 used in the coating liquid for forming the charge transporting layer in Example 10 was replaced by Compound No. I-261, whereby electrophotographic photoconductor No. 14 according to the present invention was prepared.

EXAMPLE 15

The procedure for Example 10 was repeated except that Compound No. I-5 used in the coating liquid for forming the charge transporting layer in Example 10 was replaced by Compound No. I-267, whereby electrophotographic photoconductor No. 15 according to the present invention was prepared.

EXAMPLE 16

The procedure for Example 10 was repeated except that Compound No. I-5 used in the coating liquid for forming the charge transporting layer in Example 10 was replaced by Compound No. I-274, whereby electrophotographic photoconductor No. 16 according to the present invention was prepared.

COMPARATIVE EXAMPLE 6

The procedure for Example 10 was repeated except that Compound No. I-5 used in the coating liquid for forming the charge transporting layer in Example 10 was eliminated therefrom, whereby comparative electrophotographic photoconductor No. 6 was obtained.

COMPARATIVE EXAMPLE 7

The procedure for Example 10 was repeated except that 0.04 parts by weight of Compound No. I-5 used in the coating liquid for forming the charge transporting layer in Example 10 was replaced by 0.07 parts by weight of Comparative Compound No. 1, whereby comparative electrophotographic photoconductor No. 7 was obtained.

COMPARATIVE EXAMPLE 8

The procedure for Example 10 was repeated except that 0.04 parts by weight of Compound No. I-5 used in the coating liquid for forming the charge transporting layer in Example 10 was replaced by 0.07 parts by weight of Comparative Compound No. 2, whereby comparative electrophotographic photoconductor No. 8 was obtained.

COMPARATIVE EXAMPLE 9

The procedure for Example 10 was repeated except that 0.04 parts by weight of Compound No. I-5 used in the coating liquid for forming the charge transporting layer in Example 10 was replaced by 0.07 parts by weight of Comparative Compound No. 3, whereby comparative electrophotographic photoconductor No. 9 was obtained.

COMPARATIVE EXAMPLE 10

The procedure for Example 10 was repeated except that 0.04 parts by weight of Compound No. I-5 used in the coating liquid for forming the charge transporting layer in Example 10 was replaced by 0.07 parts by weight of Comparative Compound No. 4, whereby comparative electrophotographic photoconductor No. 10 was obtained. EVALUATION 1

The electrophotographic properties of the above-prepared electrophotographic photoconductors Nos. 1 to 16 according to the present invention and comparative ones Nos. 1 to 10 were evaluated by using an electrostatic paper analyzer (Trademark "SP-428" made by Kawaguchi Electro Works) in the following manner.

Each of the above electrophotographic photoconductors was negatively charged in the dark under application of −6 kV of corona charge for 20 seconds. The surface potential, $V_2$ (−V), of the photoconductor 2 seconds after the initiation of the charging, was measured by the paper analyzer. The photoconductor was then allowed to stand in the dark without applying any charge thereto for 20 seconds. The photoconductor was then illuminated for 30 seconds by a tungsten lamp in such a manner that the illuminance on the illuminated surface of the photoconductor was 6 lux. The exposure $E_{1/10}$ (lux.sec) required to reduce the surface potential (−800 V) to −80 V was measured as an index of the photosensitivity. As to the residual potential, the surface potential, $V_{30}$ (−V), of the photoconductor 30 seconds after the illumination was measured.

The photoconductor was then exposed to a tungsten light with an illuminance of 5 lux and a color temperature of 2856° K., followed by application of −6 kV of corona charge. Such exposing and charging were repeated for 3 hours. Thereafter, the surface potentials $V_2'$ (−V) and $V_{30}'$ (−V), and the exposure $E_{1/10}'$ (lux.sec) were measured again in the same manner as mentioned above.

The results are shown in Table 1.

TABLE 1

| Photoconductor | Hydroquinone Comp'd | Initial $V_2$ (−V) | Initial $E_{1/10}$ (lux · sec) | Initial $V_{30}$ (−V) | After Fatigue $V_2'$ (−V) | After Fatigue $E_{1/10}'$ (lux · sec) | After Fatigue $V_{30}'$ (−V) |
|---|---|---|---|---|---|---|---|
| No. 1 | I-5 | 890 | 1.28 | 10 | 810 | 1.30 | 14 |
| No. 2 | I-30 | 895 | 1.28 | 12 | 825 | 1.31 | 14 |
| No. 3 | I-61 | 900 | 1.29 | 12 | 830 | 1.31 | 15 |
| No. 4 | I-82 | 905 | 1.30 | 13 | 835 | 1.33 | 16 |
| No. 5 | I-54 | 895 | 1.23 | 11 | 823 | 1.25 | 15 |
| No. 6 | I-261 | 892 | 1.24 | 10 | 820 | 1.24 | 15 |
| No. 7 | I-267 | 908 | 1.20 | 12 | 847 | 1.22 | 16 |
| No. 9 | I-36 | 868 | 1.20 | 10 | 791 | 1.21 | 17 |
| Comp. No. 1 | (none) | 830 | 1.24 | 8 | 600 | 1.22 | 12 |
| Comp. No. 2 | (No. 1*) | 850 | 1.26 | 9 | 650 | 1.23 | 15 |
| Comp. No. 3 | (No. 2*) | 840 | 1.25 | 8 | 620 | 1.23 | 20 |
| Comp. No. 4 | (No. 3*) | 835 | 1.25 | 7 | 605 | 1.22 | 12 |
| Comp. No. 5 | (No. 4*) | 870 | 1.20 | 9 | 723 | 1.20 | 15 |
| No. 10 | I-5 | 895 | 1.52 | 6 | 800 | 1.50 | 6 |
| No. 11 | I-61 | 900 | 1.53 | 6 | 815 | 1.51 | 7 |
| No. 12 | I-82 | 910 | 1.54 | 7 | 820 | 1.51 | 7 |
| No. 13 | I-54 | 900 | 1.54 | 2 | 821 | 1.51 | 1 |
| No. 14 | I-261 | 898 | 1.53 | 2 | 814 | 1.50 | 1 |
| No. 15 | I-267 | 912 | 1.54 | 3 | 830 | 1.52 | 2 |
| No. 16 | I-274 | 910 | 1.54 | 3 | 828 | 1.53 | 2 |
| Comp. No. 6 | (none) | 860 | 1.50 | 5 | 650 | 1.42 | 3 |
| Comp. No. 7 | (No. 1*) | 875 | 1.52 | 6 | 675 | 1.48 | 5 |
| Comp. No. 8 | (No. 2*) | 865 | 1.51 | 6 | 665 | 1.47 | 5 |
| Comp. No. 9 | (No. 3*) | 860 | 1.49 | 5 | 645 | 1.44 | 3 |
| Comp. No. 10 | (No. 4*) | 887 | 1.55 | 3 | 745 | 1.55 | 2 |

(Note) In the above table, No. 1*, No. 2*, No. 3* and No. 4* are Comparative Compound No. 1, Comparative Compound No. 2, Comparative Compound No. 3 and Comparative Compound No. 4, respectively.

EXAMPLE 17

15 parts by weight of an alkyd resin (Trademark "Beckosol 1307-60-EL" made by Dainippon Ink & Chemicals, Inc.) and 10 parts by weight of a melamine resin [Trademark "Superbeckamine G-821-60" made by Dainippon Ink & Chemicals, Inc.) were dissolved in 150 parts by weight of methyl ethyl ketone. To the resulting solution, 90 parts by weight of titanium oxide (Trademark "Tipaque CR-EL" made by Ishihara Sangyo Kaisha, Ltd.) was added and dispersed for 12 hours by a ball mill, thereby obtaining a coating liquid for forming an intermediate layer.

The above-prepared coating liquid was coated onto the surface of an aluminum plate with a thickness of 0.2 mm (Trademark "A1080" made by Sumitomo Light Metal Industries, Ltd.), and then dried at 140° C. for 20 minutes to form an intermediate layer with a thickness of 2 μm.

To the intermediate layer, the same coating liquid for forming a charge transporting layer as prepared in Example 1 was applied by means of dip coating and then dried, thereby forming a charge transporting layer with a thickness of 20

10 parts by weight of a polycarbonate resin (Trademark "Panlite L-1250" made by Teijin Limited) was dissoved in a mixed solvent of 75 parts by weight of 1,2-dichloroethane and 75 parts by weight of 1,1,2-trichloroethane. To the resulting solution, 3 parts by weight of the trisazo pigments having formula [a] was added and dispersed for 48 hours by a ball mill. 7 parts by weight of a charge transporting material having formula [b], 150 parts by weight of 1,2-dichloroethane and 150 parts by weight of trichloroethane were then added to the above-obtained dispersion and dispersed for 24 hours by the ball mill, thereby obtaining a coating liquid for forming a charge generating layer.

The coating liquid thus obtained was coated onto the charge transporting layer by means of spray coating and then dried, thereby forming a charge generating layer with a thickness of 3 μm.

Thus, electrophotographic photoconductor No. 17 according to the present invention was obtained.

EXAMPLE 18

The procedure for Example 17 was repeated except that Compound No. I-5 used in the coating liquid for forming the charge transporting layer in Example 17 was replaced by Compound No. I-61, whereby electrophotographic photoconductor No. 18 according to the present invention was obtained.

EXAMPLE 19

The procedure for Example 17 was repeated except that Compound No. I-5 used in the coating liquid for forming the charge transporting layer in Example 17 was replaced by Compound No. I-82, whereby electrophotographic photoconductor No. 19 according to the present invention was obtained.

EXAMPLE 20

The procedure for Example 17 was repeated except that Compound No. 1-5 used in the coating liquid for forming the charge transporting layer in Example 17 was replaced by Compound No. I-54, whereby electrophotographic photoconductor No. 20 according to the present invention was obtained.

EXAMPLE 21

The procedure for Example 17 was repeated except that Compound No. I-5 used in the coating liquid for forming the charge transporting layer in Example 17 was replaced by Compound No. I-261, whereby electrophotographic photoconductor No. 21 according to the present invention was obtained.

EXAMPLE 22

The procedure for Example 17 was repeated except that Compound No. I-5 used in the coating liquid for forming the charge transporting layer in Example 17 was replaced by Compound No. I-267, whereby electrophotographic photoconductor No. 22 according to the present invention was obtained.

COMPARATIVE EXAMPLE 11

The procedure for Example 17 was repeated except that Compound No. I-5 used in the coating liquid for forming the charge transporting layer in Example 17 was eliminated therefrom, whereby comparative electrophotographic photoconductor No. 11 was obtained.

COMPARATIVE EXAMPLE 12

The procedure for Example 17 was repeated except that 0.04 parts by weight of Compound No. I-5 used in the coating liquid for forming the charge transporting layer in Example 17 was replaced by 0.07 parts by weight of Comparative Compound 1, whereby comparative electrophtographic photoconductor No. 12 was obtained.

COMPARATIVE EXAMPLE 13

The procedure for Example 17 was repeated except that 0.04 parts by weight of Compound No. I-5 used in the coating liquid for forming the charge transporting layer in Example 17 was replaced by 0.07 parts by weight of Comparative Compound 3, whereby comparative electrophtographic photoconductor No. 13 was obtained.

EVALUATION 2

The electrophotographic properties of the above-prepared electrophotographic photoconductors Nos. 17 to 22 according to the present invention and the comparative ones Nos. 11 to 13 were evaluated.

The procedure for Evaluation 1 was repeated except that the corona charge applied to the photoconductor was changed from −6 kV to +6 kV.

The results are shown in Table 2.

TABLE 2

| Photo-con-ductor | Hydro-quinone Comp'd | Initial $V_2$ (V) | Initial $E_{1/10}$ (lux · sec) | Initial $V_{30}$ (V) | After Fatigue $V_2'$ (V) | After Fatigue $E_{1/10}'$ (lux · sec) | After Fatigue $V_{30}$ (V) |
|---|---|---|---|---|---|---|---|
| No. 17 | I-5 | 880 | 1.40 | 15 | 805 | 1.38 | 14 |
| No. 18 | I-61 | 895 | 1.42 | 16 | 820 | 1.40 | 18 |
| No. 19 | I-82 | 900 | 1.43 | 16 | 830 | 1.41 | 19 |
| No. 20 | I-54 | 904 | 1.40 | 11 | 836 | 1.37 | 15 |
| No. 21 | I-261 | 900 | 1.40 | 12 | 829 | 1.36 | 15 |
| No. 22 | I-267 | 912 | 1.42 | 14 | 851 | 1.39 | 18 |
| Comp. No. 11 | (none) | 805 | 1.35 | 10 | 550 | 1.33 | 12 |
| Comp. No. 12 | (No. 1*) | 825 | 1.37 | 11 | 605 | 1.36 | 13 |
| Comp. No. 13 | (No. 3*) | 800 | 1.34 | 9 | 545 | 1.32 | 12 |

(Note) In the above table, No. 1* and No. 3* are Comparative Compound No. 1 and Comparative Compound No. 3, respectively.

What is claimed is:

1. An electrophotographic photoconductor comprising an electroconductive support, and a photoconductive layer formed thereon, comprising (i) a charge generating material, (ii) a charge transporting material, and (iii) a hydroquinone compound having at least one group which contains 4 or more carbon atoms.

2. The electro-photographic photoconductor as claimed in claim 1, wherein said hydroquinone compound has the following formula:

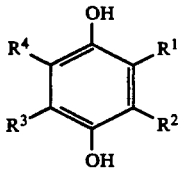

wherein $R^1$, $R^2$, $R^3$ and $R^4$ are independently hydrogen, a halogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an alkylamino group, an arylamino group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, an alkyloxycarbonyl group, an aryloxycarbonyl group, an alkylacyloxyl group, an arylacyloxyl group, a silyl group or a heterocyclic group, provided that at least one of $R^1$, $R^2$, $R^3$ and $R^4$ is a group having 4 or more carbon atoms.

3. The electrophotographic photoconductor as claimed in claim 1, wherein said hydroquinone compound has the following formula:

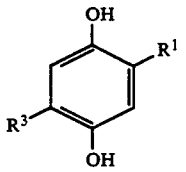

wherein $R^1$ and $R^3$ are independently hydrogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an acyl group or a heterocyclic group, provided that at least one of $R^1$ and $R^3$ is a group having 6 or more carbon atoms.

4. The electrophotographic photoconductor as claimed in claim 1, wherein said hydroquinone compound has the following formula:

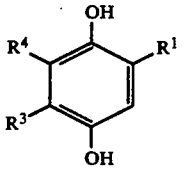

wherein $$R^1 \text{ is } -\overset{\overset{R^a}{|}}{\underset{\underset{R^b}{|}}{C}}-C_nH_{2n+1-m}R^c{}_m,$$

in which $R^a$ and $R^b$ are independently hydrogen or an alkyl group, but cannot be hydrogen at the same time, $R^c$ is a substituted or unsubstituted aryl group, an arylthio group, an aryloxy group, an arylacylamino group, an arylcarbamoyl group, an arylsulfonyl group, an aryloxycarbonyl group, an arylacyloxyl group, an arylamino group, an arylsulfonamide group or an arylsulfonyloxy group, $R^a$ and $R^b$ can be combined with $R^c$ to form a ring having 5 to 10 carbon atoms, n is an integer of 1 to 5, and m is 1 or 2, and $R^3$ or $R^4$ is a substituted or unsubstituted alkyl group having 4 to 20 carbon atoms, an aryloxy group, an alkoxyl group, a cycloalkyl group, an aryl group, an aralkyl group or the same as $R^1$.

5. The electrophotographic photoconductor as claimed in claim 1, wherein said hydroquinone compound has the following formula:

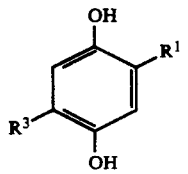

wherein $R^1$ is $-\underset{R^b}{\overset{R^a}{C}}-(CH_2)_nR^c$, in which $R^a$ and $R^b$ are independently an alkyl group having 1 to 5 carbon atoms, $R^c$ is a saturated or unsaturated aryl group, an arylthio group, an aryloxy group, an arylacylamino group, an arylcarbamoyl group, an arylsulfonyl group, an aryloxycarbonyl group, an arylacyloxyl group, an arylamino group, an arylsulfonamide group or an arylsulfonyloxy group, $R^1$ and $R^b$ can be combined with $R^c$ to form a ring having 5 to 10 carbon atoms, and n is an integer of 1 to 5, and $R^3$ is a substituted or unsubstituted cycloalkyl group, an aryl group or the same as $R^1$.

6. The electrophotographic photoconductor as claimed in claim 1, wherein said photoconductive layer further comprises a binder resin.

7. The electrophotographic photoconductor as claimed in claim 6, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

8. The electrophotographic photoconductor as claimed in claim 1, further comprising a non-photosensitive intermediate layer between said electroconductive support and said photoconductive layer.

9. The electrophotographic photoconductor as claimed in claim 1, wherein the amount of said hydroquinone compound is 0.01 to 5.0 wt. % of the weight of said charge transporting material.

10. The electrophotographic photoconductor as claimed in claim 1, wherein said photoconductive layer has a thickness of 5 to 50 μm.

11. The electrophotographic photoconductor as claimed in claim 1, wherein said photoconductive layer comprises a charge generating layer comprising said charge generating material and a charge transporting layer comprising said charge transporting material, said charge generating layer and said charge transporting layer being formed on said electroconductive support in an optional order, said hydroquinone compound being contained in one of or both of said charge generating layer and said charge transporting layer.

12. The electrophotographic photoconductor as claimed in claim 11, wherein said hydroquinone compound is contained in said charge transporting layer.

13. The electrophotographic photoconductor as claimed in claim 11, wherein the amount of said hydroquinone compound is 0.1 to 20.0 wt. % of the weight of said charge generating material when contained in said charge generating layer, and 0.01 to 10.0 wt. % of the weight of said charge transporting material when contained in said charge transporting layer.

14. The electrophotographic photoconductor as claimed in claim 11, wherein said charge generating layer has a thickness of 0.1 to 5 μm, and said charge transporting layer has a thickness of 5 to 50 μm.

15. The electrophotographic photoconductor as claimed in claim 11, further comprising a non-photosensitive intermediate layer between said electroconductive support and said charge generating layer or said charge transporting layer which is overlaid on said electroconductive support.

16. The electrophotographic photoconductor as claimed in claim 11, wherein when said charge transporting layer is overlaid on said charge generating layer, at least said charge transporting layer further comprises a binder resin, and when said charge generating layer is overlaid on said charge transporting layer, said charge generating layer and said charge transporting layer both further comprise a binder resin.

17. The electrophotographic photoconductor as claimed in claim 16, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

18. An electrophotographic photoconductor comprising an electroconductive support, and a photoconductive layer formed thereon, comprising a charge generating layer which comprises a charge generating material and a charge transporting layer which comprises a charge transporting material, said charge generating layer and said charge transporting layer being formed on said electroconductive support in an optional order, and a hydroquinone compound of the following formula being contained in one of or both of said charge generating layer and said charge transporting layer:

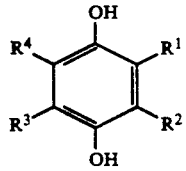

wherein $R^1$, $R^2$, $R^3$ and $R^4$ are independently hydrogen, a halogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an alkylamino group, an arylamino group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, an alkyloxycarbonyl group, an aryloxycarbonyl group, an alkylacyloxyl group, an arylacyloxyl group, a silyl group or a heterocyclic group, provided that at least one of $R^1$, $R^2$, $R^3$ and $R^4$ is a group having 4 or more carbon atoms.

19. The electrophotographic photoconductor as claimed in claim 18, wherein said hydroquinone compound is contained in said charge transporting layer.

20. The electrophotographic photoconductor as claimed in claim 18, wherein the amount of said hydroquinone compound is 0.1 to 20.0 wt. % of the weight of said charge generating material when contained in said charge generating layer, and 0.01 to 10.0 wt. % of the weight of said charge transporting material when contained in said charge transporting layer.

21. The electrophotographic photoconductor as claimed in claim 18, wherein said charge generating layer has a thickness of 0.1 to 5 μm, and said charge transporting layer has a thickness of 5 to 50 μm.

22. The electrophotographic photoconductor as claimed in claim 18, further comprising a non-photosensitive intermediate layer between said electroconductive support and said charge generating layer or said charge transporting layer which is overlaid on said electroconductive support.

23. The electrophotographic photoconductor as claimed in claim 18, wherein when said charge transporting layer is overlaid on said charge generating layer, at least said charge transporting layer further comprises a binder resin, and when said charge generating layer is overlaid on said charge transporting layer, said charge generating layer and said charge transporting layer both further comprise a binder resin.

24. The electrophotographic photoconductor as claimed in claim 23, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

25. An electrophotographic photoconductor comprising an electroconductive support, and a photoconductive layer formed thereon, comprising a charge generating layer which comprises a charge generating material and a charge transporting layer which comprises a charge transporting material, said charge generating layer and said charge transporting layer being formed on said electroconductive support in an optional order, and a hydroquinone compound of the following formula being contained in one of or both of said charge generating layer and said charge transporting layer:

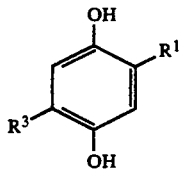

wherein $R^1$ and $R^3$ are independently hydrogen, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, an alkylthio group, an arylthio group, an acyl group or a heterocyclic group, provided that at least one of $R^1$ and $R^3$ is a group having 6 or more carbon atoms.

26. The electrophotographic photoconductor as claimed in claim 25, wherein said hydroquinone compound is contained in said charge transporting layer.

27. The electrophotographic photoconductor as claimed in claim 25, wherein the amount of said hydroquinone compound is 0.1 to 20.0 wt. % of the weight of said charge generating material when contained in said charge generating layer, and 0.01 to 10.0 wt. % of the weight of said charge transporting material when contained in said charge transporting layer.

28. The electrophotographic photoconductor as claimed in claim 25, wherein said charge generating layer has a thickness of 0.1 to 5 μm, and said charge transporting layer has a thickness of 5 to 50 μm.

29. The electrophotographic photoconductor as claimed in claim 25, further comprising a non-photosensitive intermediate layer between said electroconductive support and said charge generating layer or said charge transporting layer which is overlaid on said electroconductive support.

30. The electrophotographic photoconductor as claimed in claim 25, wherein when said charge transporting layer is overlaid on said charge generating layer, at least said charge transporting layer further comprises a binder resin, and when said charge generating layer is overlaid on said charge transporting layer, said charge generating layer and said charge transporting layer both further comprise a binder resin.

31. The electrophotographic photoconductor as claimed in claim 30, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

32. An electrophotographic photoconductor comprising an electroconductive support, and a photoconductive layer formed thereon, comprising a charge generating layer which comprises a charge generating material and a charge transporting layer which comprises a charge transporting material, said charge generating layer and said charge transporting layer being formed on said electroconductive support in an optional order, and a hydroquinone compound of the following formula being contained in one of or both of said charge generating layer and said charge transporting layer:

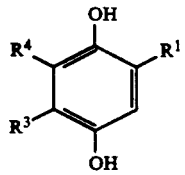

wherein $R^1$ is $-\overset{R^a}{\underset{R^b}{C}}-C_nH_{2n+1-m}R^c_m$, in which $R^a$ and $R^b$ are independently hydrogen or an alkyl group, but cannot be hydrogen at the same time, $R^c$ is a substituted or unsubstituted aryl group, an arylthio group, an aryloxy group, an arylacylamino group, an arylcarbamoyl group, an arylsulfonyl group, an aryloxycarbonyl group, an arylacyloxyl group, an arylamino group, an arylsulfonamide group or an arylsulfonyloxy group, $R^a$ and $R^b$ can be combined with $R^c$ to form a ring having 5 to 10 carbon atoms, n is an integer of 1 to 5, and m is 1 or 2, and $R^3$ or $R^4$ is a substituted or unsubstituted alkyl group having 4 to 20 carbon atoms, an aryloxy group, an alkoxyl group, a cycloalkyl group, an aryl group, an aralkyl group or the same as $R^1$.

33. The electrophotographic photoconductor as claimed in claim 32, wherein said hydroquinone compound is contained in said charge transporting layer.

34. The electrophotographic photoconductor as claimed in claim 32, wherein the amount of said hydroquinone compound is 0.1 to 20.0 wt. % of the weight of said charge generating material when contained in said charge generating layer, and 0.01 to 10.0 wt. % of the weight of said charge transporting material when contained in said charge transporting layer.

35. The electrophotographic photoconductor as claimed in claim 32, wherein said charge generating layer has a thickness of 0.1 to 5 μm, and said charge transporting layer has a thickness of 5 to 50 μm.

36. The electrophotographic photoconductor as claimed in claim 32, further comprising a non-photosensitive intermediate layer between said electroconductive support and said charge generating layer or said charge transporting layer which is overlaid on said electroconductive support.

37. The electrophotographic photoconductor as claimed in claim 32, wherein when said charge transporting layer is overlaid on said charge generating layer, at least said charge transporting layer further comprises a binder resin, and when said charge generating layer is overlaid on said charge transporting layer, said charge generating layer and said charge transporting layer both further comprise a binder resin.

38. The electrophotographic photoconductor as claimed in claim 37, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

39. An electrophotographic photoconductor comprising an electroconductive support, and a photoconductive layer formed thereon, comprising a charge generating layer which comprises a charge generating material and a charge transporting layer which comprises a charge transporting material, said charge generating layer and said charge transporting layer being formed on said electroconductive support in an optional order, and a hydroquinone compound of the following formula being contained in one of or both of said charge generating layer and said charge transporting layer:

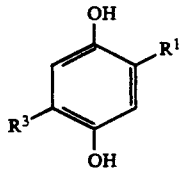

wherein $R^1$ is $-\overset{R^a}{\underset{R^b}{C}}-(CH_2)_nR^c$, in which $R^a$ and $R^b$ are independently an alkyl group having 1 to 5 carbon atoms, $R^c$ is a saturated or unsaturated aryl group, an arylthio group, an aryloxy group, an arylacylamino group, an arylcarbamoyl group, an arylsulfonyl group, an aryloxycarbonyl group, an arylacyloxyl group, an arylamino group, an arylsulfonamide group or an arylsulfonyloxy group, $R^a$ and $R^b$ can be combined with $R^c$ to form a ring having 5 to 10 carbon atoms, and n is an integer of 1 to 5, and $R^3$ is a substituted or unsubstituted cycloalkyl group, an aryl group or the same as $R^1$.

40. The electrophotographic photoconductor as claimed in claim 39, wherein said hydroquinone compound is contained in said charge transporting layer.

41. The electrophotographic photoconductor as claimed in claim 39, wherein the amount of said hydroquinone compound is 0.1 to 20.0 wt. % of the weight of said charge generating material when contained in said charge generating layer, and 0.01 to 10.0 wt. % of the weight of said charge transporting material when contained in said charge transporting layer.

42. The electrophotographic photoconductor as claimed in claim 39, wherein said charge generating layer has a thickness of 0.1 to 5 μm, and said charge transporting layer has a thickness of 5 to 50 μm.

43. The electrophotographic photoconductor as claimed in claim 39, further comprising a non-photosensitive intermediate layer between said electroconductive support and said charge generating layer or said charge transporting layer which is overlaid on said electroconductive support.

44. The electrophotographic photoconductor as claimed in claim 39, wherein when said charge transporting layer is overlaid on said charge generating layer, at least said charge transporting layer further comprises a binder resin, and when said charge generating layer is overlaid on said charge transporting layer, said charge generating layer and said charge transporting layer both further comprise a binder resin.

45. The electrophotographic photoconductor as claimed in claim 44, wherein said binder resin is selected from the group consisting of bisphenol A type polycarbonate, bisphenol Z type polycarbonate, polyester, a methacrylic resin, an acrylic resin, polyethylene, vinylchloride, vinylacetate, polystyrene, a phenol resin, an epoxy resin, polyurethane, polyvinylidene chloride, an alkyd resin, a silicone resin, polyvinyl carbazole, polyvinyl butyral, polyvinyl formal, polyacrylate, polyacryl amide, polyamide and a phenoxy resin.

* * * * *

UNITED STATES PATENT AND TRADEMARK OFFICE

CERTIFICATE OF CORRECTION

PATENT NO. : 5,286,588

DATED : FEBRUARY 15, 1994

INVENTOR(S) : YASUO SUZUKI ET AL

It is certified that error appears in the above-identified patent and that said Letters Patent is hereby corrected as shown below:

Column 2, line 21, "minimized: On" should read --minimized. On --;

line 31, "and the recrease" should read --and the decrease--.

Column 4, line 41, "formula III]" should read --formula [III]--.

Column 50, lines 19-20, "a distiryloxadiazole" should read --a distiryloxadiazole structure--.

Column 56, line 60, "phenoyy resin" should read --phenoxy resin--.

Column 61, line 23, "No. 2 (Trdemark" should read --No. 2 (Trademark--.

Column 62, line 20, "EXAMPLE 1" should read --EXAMPLE 10--.

UNITED STATES PATENT AND TRADEMARK OFFICE

CERTIFICATE OF CORRECTION

PATENT NO. : 5,286,588

DATED : FEBRUARY 15, 1994

INVENTOR(S) : YASUO SUZUKI ET AL

It is certified that error appears in the above-identified patent and that said Letters Patent is hereby corrected as shown below:

Column 66, line 10, "thickness of 20" should read --thickness of 20 μm.--.

Signed and Sealed this

Eleventh Day of April, 1995

*Attest:*

*Attesting Officer*

BRUCE LEHMAN

*Commissioner of Patents and Trademarks*